US005278014A

United States Patent [19]

Tamaki et al.

[11] Patent Number: 5,278,014

[45] Date of Patent: Jan. 11, 1994

[54] ELECTROPHOTOGRAPHIC PHOTORECEPTOR

[75] Inventors: Kiyoshi Tamaki; Shigeki Takeuchi, both of Hachioji, Japan

[73] Assignee: Konica Corporation, Tokyo, Japan

[21] Appl. No.: 896,156

[22] Filed: Jun. 10, 1992

[30] Foreign Application Priority Data

Jun. 21, 1991 [JP] Japan ..... 3-177529
Jul. 10, 1991 [JP] Japan ..... 3-195763

[51] Int. Cl.[5] ..... G03G 5/047
[52] U.S. Cl. ..... 430/58
[58] Field of Search ..... 430/58

[56] References Cited

U.S. PATENT DOCUMENTS

| | | | |
|---|---|---|---|
| 4,618,551 | 10/1986 | Stolka et al. | 430/58 |
| 4,758,488 | 7/1988 | Johnson et al. | 430/59 |
| 4,772,525 | 9/1988 | Badesha et al. | 430/58 |
| 4,855,201 | 8/1989 | Badesha et al. | 430/58 |
| 5,122,429 | 6/1992 | Sundararajan et al. | 430/64 X |
| 5,130,214 | 7/1992 | Yokoyama et al. | 430/59 X |
| 5,166,016 | 11/1992 | Badesha et al. | 430/58 |

FOREIGN PATENT DOCUMENTS

| | | | |
|---|---|---|---|
| 50-10496 | 4/1975 | Japan . | |
| 51-94829 | 8/1976 | Japan . | |
| 52-72231 | 6/1977 | Japan . | |
| 53-27033 | 3/1978 | Japan . | |
| 55-52063 | 4/1980 | Japan . | |
| 58-65440 | 4/1983 | Japan . | |
| 58-198425 | 11/1983 | Japan . | |
| 62-269964 | 11/1987 | Japan . | |
| 153553 | 6/1988 | Japan | 430/58 |
| 63-285552 | 11/1988 | Japan . | |

*Primary Examiner*—Roland Martin
*Attorney, Agent, or Firm*—Frishauf, Holtz, Goodman & Woodward

[57] ABSTRACT

Disclosed is an electrophotographic photoreceptor which comprises a conductive substrate and a photosensitive layer formed thereon, wherein the photosensitive layer contains a polysilane which is a homopolymer or a copolymer having at least one of repeating units represented by Formula (I) and Formula (II), and at least one of degradation inhibitors represented by Formula (III) through Formula (VIII), Formula (I)

Formula (II)

wherein $R_1$, $R_2$, $R_3$ and $R_4$ each represents a hydrogen atom, a halogen atom, a substituted or unsubstituted alkyl group, a substituted or unsubstituted aryl group, a substituted or unsubstituted alkoxy group, an alkylsilyl group or an arylsilyl group, Formula (III)

Formula (IV)

wherein $A_1$ represents an oxygen atom or a sulfur atom $R_{12}$—$A_2$—COCOOH Formula (V)

(Abstract continued on next page.)

ABSTRACT
wherein $R_{12}$ represents an aryl group or a substituted group, $A_2$ represents $—CH_2—$ or $—CH{=}CR_{13}—$, $R_{13}$ represents a hydrogen atom or a halogen atom,
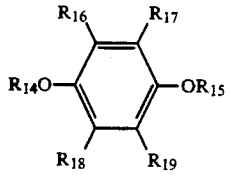
Formula (VI)
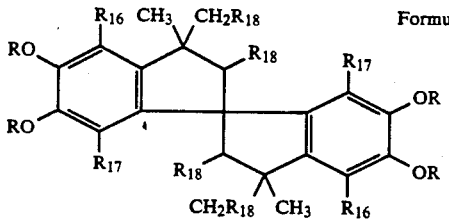
Formula (VII)
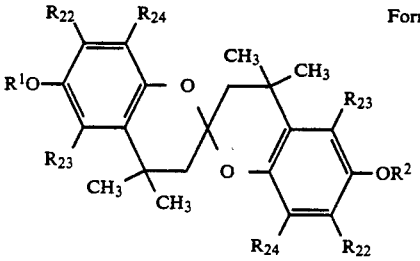
Formula (VIII)
An electrophotographic photoreceptor according to this invention is improved in photoreceptivity, residual potential and photoreception speed.
6 Claims, 2 Drawing Sheets

ELECTROPHOTOGRAPHIC PHOTORECEPTOR

FIELD OF THE INVENTION

The present invention relates to an electrophotographic photoreceptor, particularly to an electrophotographic photoreceptor having an excellent carrier transfer property, a high sensitivity and a high durability.

DESCRIPTION OF THE PRIOR ART

As the electrophotographic photoreceptor, there have so far been widely used inorganic photoreceptors having a photosensitive layer comprised mainly of an inorganic photoconductive material such as selenium, zinc oxide or cadmium sulfide. However, such inorganic photoreceptors are not necessarily satisfactory in photosensitivity, heat stability, moisture resistance and durability required of electrophotographic photoreceptors for copying machines, etc.

In order to solve these problems involved in inorganic photoreceptors, there has been attempted in recent years to use various organic photoconductive materials in the photosensitive layer of electrophotographic photoreceptors. For example, Japanese Pat. Exam. Pub. No. 10496/1975 discloses an organic photoreceptor containing poly-N-vinylcarbazole and 2,4,7-trinitrofluorenone, but this photoreceptor is not satisfactory in sensitivity and durability. To eliminate such disadvantages, an organic electophotographic photoreceptor is developed, in which a charge generation function and a charge transfer function are separately provided by different substances. Such a function-separating electrophotographic photoreceptor has an advantage that the materials for respective functions can be selected from a wide range of compounds. This enables to obtain organic photoreceptors of desired properties with ease, and thereby one having a high sensibity and an excellent durability can be prepared.

There have been proposed various azo compounds, condensed polycyclic compounds and phthalocyanine compounds as a charge generation material to bear the charge generation function and a variety of compounds as a charge transfer material responsible for the charge transfer function in, for example, Japanese Pat. O.P.I. Pub. Nos. 94829/1976, 72231/1977, 27033/1978, 52063/1980, 65440/1983 and 198425/1983.

However, function-separating photoreceptors comprised of the above charge transfer material are not necessarily satisfactory in charge transfer property, and when used in a rapid copying process at a low environmental temperature, they cause disadvantages such as deterioration in sensitivity and rise in residual potential. Further, when the simplification of copying process is attemped by decreasing the size of photoreceptor drums, conventional charge transfer materials are not suited for such attempts because of their low charge transfer capability and, therefore, inevitably lead to drop in process speed.

Under the circumstances, there has come to be proposed recently a photoreceptor which uses a polysilane having a specific structure as a charge (positive hole) transfer material (see Japanese Pat. 0.P.I. Pub. Nos. 10747/1986, 269964/1987 and 285552/1988). Such a polysilane has a film-forming property by itself unlike conventional charge transfer materials, and thereby it can readily form a filmy photoreceptive layer without being combined with other binders. Moreover, it has a hole mobility of the order of $10^{-4}$ cm2/V sec or more, which is ten or more times as large as that of conventional charge transfer materials.

PROBLEMS TO BE SOLVED BY THE INVENTION

However, a photoreceptive layer comprised of this polysilane is poor in chemical resistances against light and ozone and, therefore, susceptible to degradation. This is attibuted to cleavage of polysilane main chains, which leads to formation of terminal —SiO— bonds; as a result, the photoconductivity is lost and in turn the residual potential rises. Though UV absorbents and anti-oxidants are used to avoid the degradation, conventional UV absorbents and anti-oxidants are not necessarily satisfactory in preventing the degradation; moreover, some of them have a tendency to lower the sensitivity. Under such circumstances, there has been demanded a polysilane type photoreceptor free from sensitivity drop and high in anti-degradation property.

The present invention is accomplished to solve the above problems. Accordingly, the object of the invention is to provide an electophotographic photoreceptor excellent in the ability of charge transport, high in sensitivity and excellent in the stability of surface electric potential.

Through a close study, the present inventors have found that use of the degradation inhibitor of the invention in a polysilane-containing photoreceptor can provide a photorecepor far better than conventional ones in anti-degradation property and practical for having no adverse effect on other electrophotographic properties, and that the image quality can be noticeably improved due to the increase in flexibility of a photoreceptor.

MEANS TO SOLVE THE PROBLEMS

The object of the invention is achieved by an elecrophotographic photoreceptor having on a conductive support a charge transfer layer containing at least a polysilane and a degradation inhibitor, wherein the polysilane is a homopolymer or a copolymer having the repeating unit represented by the following Formula (I) and/or Formula (II) and degradation inhibitors are a compound represented by the following Formula (III), (IV), (V), (VI), (VII) or (VIII):

Formula (I)

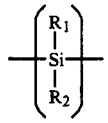

Formula (II)

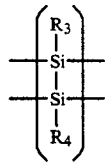

(wherein $R_1$, $R_2$, $R_3$ and $R_4$ each represent a hydrogen atom, a halogen atom, a substituted or unsubstituted alkyl group, a substituted or unsubstituted aryl group, a substituted or unsubstituted alkoxy group, an alkylsilyl group or an arylsilyl group)

Formula (III)

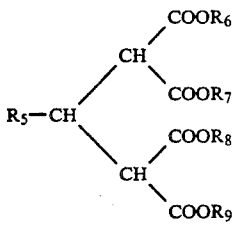

(wherein $R_5$, $R_6$, $R_7$, $R_8$ and $R_9$ each represent a hydrogen atom, an alkyl group, an aryl group, an aralkyl group, a cycloalkyl group or a heterocyclic group)

Formula (IV)

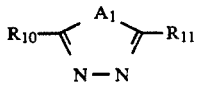

(wherein $A_1$ represents an oxygen atom or a sulfur atom; $R_{10}$ and $R_{11}$ each represent an alkyl group, an aryl group, an alkenyl group, an aralkyl group or another organic group containing

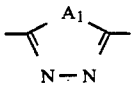

group)

$R_{12}$—$A_2$—COCOOH Formula (V)

(wherein $R_{12}$ represents an aryl group or a substituted aryl group; $A_2$ represents —$CH_2$— or —CH=$CR_{13}$—; and $R_{13}$ represents a hydrogen atom or a halogen atom)

Formula (VI)

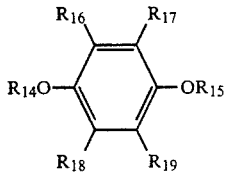

(wherein $R_{14}$ and $R_{15}$ each represent an alkyl group, an alkenyl group, a cycloalkyl group, an aryl group or a heterocyclic group; $R_{16}$, $R_{17}$, $R_{18}$ and $R_{19}$ each represent a hydrogen atom, a halogen atom, an alkyl group, an alkenyl group, a cycloalkyl group, an aryl group, an alkoxy group, an alkylthio group, an aryloxy group, an arylthio group, an acyl group, an acylamino group, an alkylamino group, an alkoxycarbonyl group or a sulfonamide group; the total number of carbon atoms is 3 or more, provided that both $R_{14}$ and $R_{15}$ are alkyl groups)

Formula (VII)

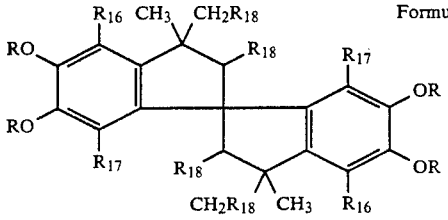

(wherein R represents an alkyl group, an alkenyl group, an aryl group, a heterocyclic group, $R_{19}CO$—, $R_{20}SO_2$— or $R_{21}NHCO$—; $R_{16}$ and $R_{17}$ each represent a hydrogen atom, a halogen atom, an alkyl group, an alkenyl group, an alkoxy group or an alkenoxy group; $R_{18}$ represents a hydrogen atom, an alkyl group, an alkenyl group or an ary group; and $R_{19}$, $R_{20}$ and $R_{21}$ each represent an alkyl group, an alkenyl group, an aryl group or a heterocyclic group)

Formula (VIII)

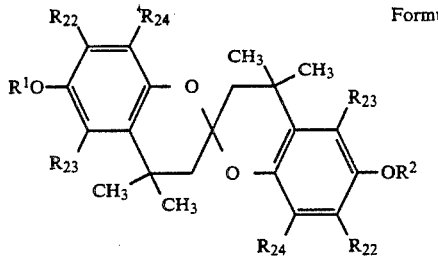

(wherein $R_{22}$ represents an alkyl group, an alkenyl group, an aryl group, an alkoxy group, an alkenoxy group or an aryloxy group; $R_{23}$ and $R_{24}$ each represent a hydrogen atom, a halogen atom, an alkyl group, an alkenyl group or an alkoxy group; $R^1$ represents an alkyl group, an alkenyl group, a cycloalkyl group, an aryl group, a heterocyclic group, $R_{25}CO$—, $R_{26}SO_2$— or $R_{27}NHCO$—; $R^2$ represents a hydrogen atom, an alkyl group, an alkenyl group, $R_{25}CO$—, $R_{26}SO_2$— or $R_{27}NHCO$—; and $R_{25}$, $R_{26}$ and $R_{27}$ each represent an alkyl group, an alkenyl group, a cycloalkyl group, an aryl group or a heterocyclic group).

The present invention is hereunder described in detail.

The electrophotographic photoreceptor of the invention contains a polysilane in the charge transfer layer, and said polysilane is a homopolymer or a copolymer having the repeating unit represented by the following Formula (I) and/or Formula (II):

Formula (I)

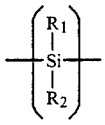

Formula (II)

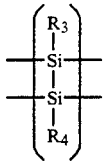

(wherein $R_1$, $R_2$, $R_3$ and $R_4$ each represent a hydrogen atom, a halogen atom, an ether group, a substituted or unsubstituted alkyl group, a substituted or unsubstituted aryl group, a substituted or unsubstituted alkoxy group, an alkylsilyl group or an arylsilyl group).

The alkyl group represented by $R^1$ or $R^2$ in Formula (I) includes straight-chain or branched alkyl groups having 1 to 24, preferably 1 to 8, carbon atoms such as a methyl, ethyl, propyl, butyl, amyl, hexyl, octyl, nonyl, decyl, pentadecyl, stearyl and cyclohexyl group.

The aryl group includes preferably those having 6 to 24 carbon atoms such as a phenyl, naphthyl and anthryl group.

The alkoxy group includes preferably those having 1 to 10 carbon atoms such as a methoxy, ethoxy, propoxy and butoxy group.

The alkenyl group includes preferably those having 2 to 10 carbon atoms such as a vinyl, allyl and butenyl group.

The alkylsilyl group includes $-SiH(CH_3)_2$, $-Si(CH_3)_3$, $-Si(C_2H_5)_3$, $-Si(C_3H_7)_3$, $-Si(C_4H_9)_3$, $-Si(CH_3)_2(C_2H_5)$ and $-Si(CH_3)(C_2H_5)_2$.

The arylsilyl group includes $-SiH(C_6H_5)_2$ and $-Si(CH_3)_2(C_6H_5)$

The alkyl, aryl and alkoxy group represented by the above R1 or R2 may have a substituent such as an alkyl, alkoxy, aryl, amino, nitro or cyano group, a halogen atom or another substituent.

Preferable examples of the repeating unit represented by Formula (I) are shown below, where the structure

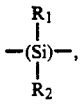

etc are expressed by $-(R_1)Si(R_2)-$, $-(R_1)_2Si-$ or the like.

$-(C_3H_7)Si(CH_3)-$ 1

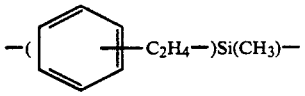
2

$-(i\text{-}C_3H_7)Si(CH_3)-$ 3

$-(C_4H_9)Si(CH_3)-$ 4

$-(t\text{-}C_4H_9)Si(CH_3)-$ 5

$-(C_6H_{13})Si(CH_3)-$ 6

$-(C_{12}H_{25})Si(CH_3)-$ 7

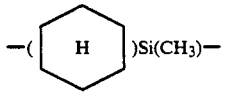
8

$-(C_3H_7)Si(C_3H_7)-$ 9

$-(C_4H_9)Si(C_4H_9)-$ 10

$-(C_5H_{11})_2Si-$ 11

$-(C_6H_{13})_2Si-$ 12

$-(C_7H_{15})_2Si-$ 13

$-(C_8H_{17})_2Si-$ 14

$-(C_{10}H_{21})_2Si-$ 15

$-(C_{12}H_{25})_2Si-$ 16

$-(C_{14}H_{29})_2Si-$ 17

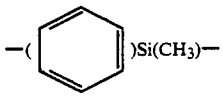
18

-continued

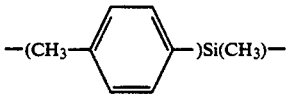
19

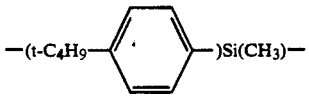
20

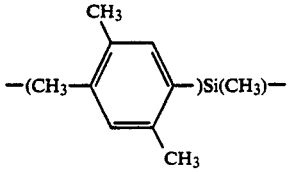
21

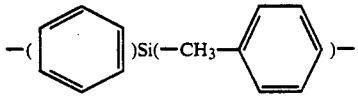
22

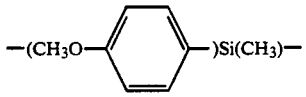
23

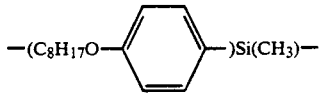
24

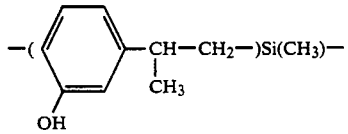
25

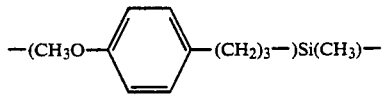
26

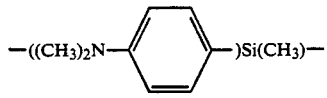
27

$-((CH_3)_3Si-)Si(CH_3)-$ 28

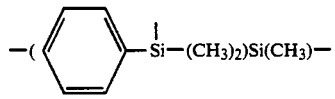
29

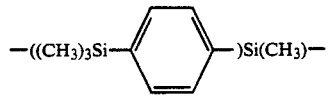
30

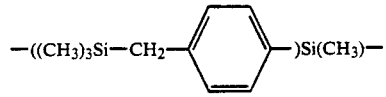
31

-continued

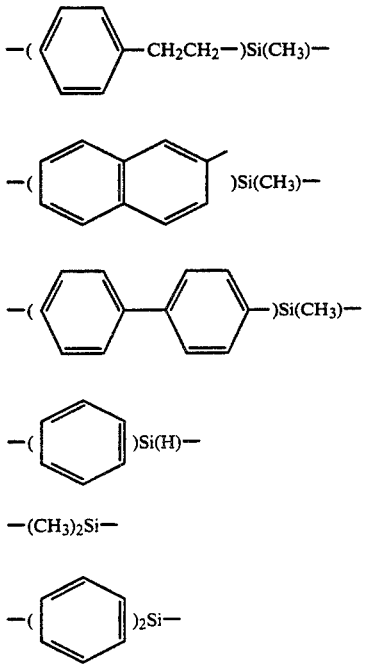

In the invention, it is preferable that these compounds have a molecular weight to give a weight average molecular weight of 5,000 to 20,000 in styrene equivalent.

In Formula (II), the alkyl group represented by R3 or R4 is preferably one having 20 or less carbon atoms; examples thereof include a methyl, ethyl, n-propyl, iso-propyl, n-butyl, iso-butyl, t-butyl, n-pentyl, neo-pentyl, n-hexyl, n-octyl and hexadecyl group; the halogen atom represented by $R_3$ or $R_4$ includes a chlorine, bromine and iodine; the aryl group includes a phenyl, tolyl, xylyl, biphenyl or naphthyl group; the alkoxy group includes a methoxy, ethoxy, isopropoxy and phenoxy group. These groups may have a substituent such as a carboxyl, amino, hydroxyl or aldehye group or a halogen atom.

The polysilane used in the invention includes cyclotetrasilanes; typical examples thereof include decamethyl bicyclo[2.2.0]hexasilane, decaisopropyl bicyclo[2.2.0]hexasilane, dodecamethyl tricyclo[4.2.0.0$^{2,5}$]octasilane, dodecaisopropyl tricyclo[4.2.0.0$^{2,5}$] octasilane, tetradecaisopropyl tetracyclo[6.2.0.0$^{2,7}$,0$^{3,6}$]decasilane, hexadecaisopropyl pentacyclo[8.2.0.0$^{2,9}$,0$^{3,84,7}$]dodecasilane,

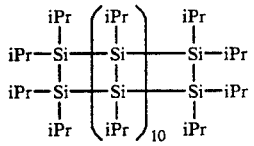

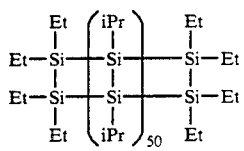

(wherein iPr is an isopropyl group, Et is an ethyl group.)

In the invention, preferred polysilanes are those having a molecular weight to give a weight average molecular weight of 1,000–2,000,000 in styrene equivalent.

The polymerization degree of these polysilanes is preferred to be in the range of 10 to 200,000.

In the invention, these polysilanes may be multicomponent copolymers consisting of random copolymers or block copolymers having suitable repeating units as illustrated below:

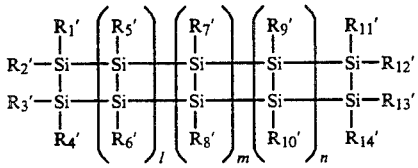

In the formula, l, m and n each represent zero or a positive integer; $R_1'$ to $R'_{14}$ each represent a hydrogen atom, a halogen atom, an ether group, an alkyl group, a hydroxyl group, an alkenyl group or an aryl group; $R_1'$, $R_2'$, $R_3'$, $R_4'$, . . . $R_{11}'$, $R_{12}'$ or $R_{13}'$, $R_{14}'$ is a terminal group and preferably a halogen atom, a hydroxy group, —O—Si(R')$_3$ (R' is a substituent), an alkoxyl group, an alkyltioether group or an arylthioether group; further, these groups may be condensed with another molecule to form a different molecule.

These polysilanes are disclosed, for example, in Japanese Pat. O.P.I. Pub. No. 19853/1990 and can be easily synthesized according to the methods disclosed in Japanese Pat. Appl. No. 138287/1987 and Japanese Pat. O.P.I. Pub. No. 19853/1990 or the methods described in Japanese Pat. O.P.I. Pub. No. 170747/1986, R. West, J. Organic Chem., 300, 327 (1986) and R. D. Miller and J. Michl, Chemical Reviews, Vol. 89, p. 1359 (1989).

The electrophotographic photoreceptor of the invention contains, in its charge transfer layer, a degradation inhibitor represented by Formula (III), Formula (IV), Formula (V), Formula (VI), Formula (VII) or Formula (VIII).

In Formula (III), the alkyl group represented by R5, R6, R7, R8 or R9 may be straight-chained or branched, and examples thereof include a methyl, ethyl, propyl, butyl, t-butyl, octyl, t-octyl, dodecyl, sec-dodecyl, hexadecyl, octadecyl and eicosyl group; the aryl group includes a phenyl and naphthyl group; the aralkyl group includes a benzyl, phenylethyl, methylbenzyl and naphthylmethyl group; the cycloalkyl group includes a cyclopentyl, cyclohexyl and cycloheptyl group; the heterocyclic group is preferably a heterocycle containing a nitrogen, oxygen or sulfur atom, and examples thereof include a furyl, pyranyl, tetrahydropyranyl, imidazolyl, pyronyl, pyrimidinyl, pyrazinyl, triazinyl, thienyl, quinolyl, oxazolyl, thiazolyl and pyridinyl group.

Typical examples of the compounds represented by Formula (III) and preferably used in the invention are as follows:

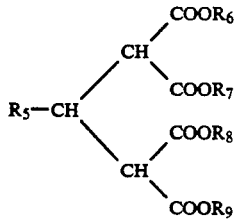

| No. | $R_5$ | $R_6$ | $R_7$ | $R_8$ | $R_9$ |
|---|---|---|---|---|---|
| III-(1) | $CH_3$ | $CH_3$ | $CH_3$ | $CH_3$ | $CH_3$ |
| III-(2) | $CH_3$ | $C_2H_5$ | $C_2H_5$ | $C_2H_5$ | $C_2H_5$ |
| III-(3) | $C_2H_5$ | $CH_3$ | $CH_3$ | $CH_3$ | $CH_3$ |
| III-(4) | $C_2H_5$ | $C_2H_5$ | $C_2H_5$ | $C_2H_5$ | $C_2H_5$ |
| III-(5) | $CH_3$ | 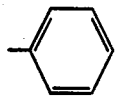 | $CH_3$ | $CH_3$ | $CH_3$ |
| III-(6) | $CH_3$ | 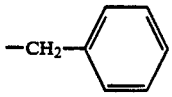 | $CH_3$ | $CH_3$ | $CH_3$ |
| III-(7) | $CH_3$ | 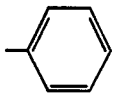 | $CH_3$ | H | $CH_3$ |
| III-(8) | $C_2H_5$ | $C_2H_5$ | $C_2H_5$ | 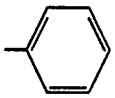 | 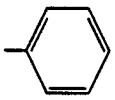 |
| III-(9) | $C_2H_5$ | H | H | H | H |
| III-(10) | $C_3H_7$ | $C_2H_5$ | $C_2H_5$ | $C_2H_5$ | $C_2H_5$ |

The addition amount of the compounds represented by Formula (II) varies with the type of polysilanes, et., but usually 0.1 to 100 wt%, preferably 0.5 to 50 wt% and especially 1 to 25 wt% of the polysilane.

In Formula (IV), the alkyl, aryl or arlkyl group represented by $R_{10}$ or $R_{11}$ is the same as that represented by $R_5$ to $R_9$ in Formula (III); the alkenyl group is, for example, an allyl, butenyl, octenyl or oleyl group.

Typical examples of the compounds represented by Formula (IV) and preferably used in the invention are as follows:

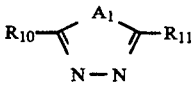

| No. | $A_1$ | $R_{10}$ | $R_{11}$ |
|---|---|---|---|
| IV-(1) | O | 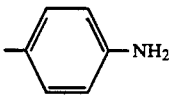 | 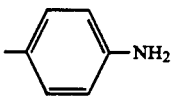 |
| IV-(2) | O | 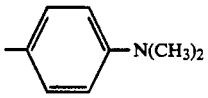 | 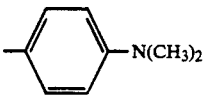 |
| IV-(3) | O | 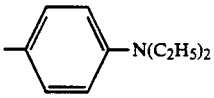 | 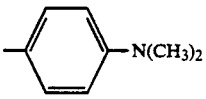 |

-continued

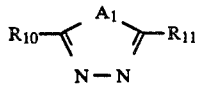

| No. | $A_1$ | $R_{10}$ | $R_{11}$ |
|---|---|---|---|
| IV-(4) | O | 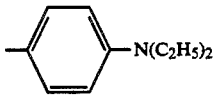 | 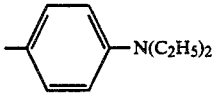 |
| IV-(5) | O | 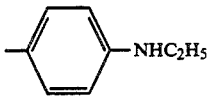 | 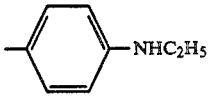 |
| IV-(6) | S | 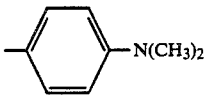 | 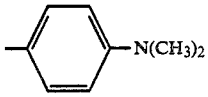 |
| IV-(7) | S | 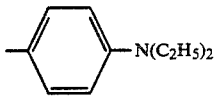 | 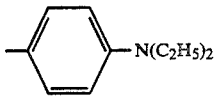 |
| IV-(8) | S | 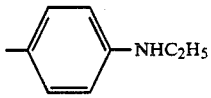 | 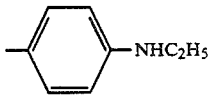 |
| IV-(9) | O | 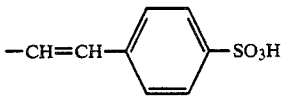 | 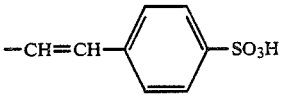 |
| IV-(10) | O | 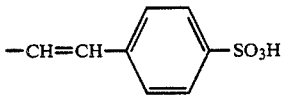 | 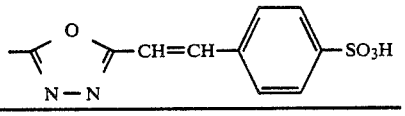 |

The addition amount of the compounds represented by Formula (II) varies with the type of polysilanes, et., but usually 0.1 to 100 wt%, preferably 0.5 to 50 wt% and especially 1 to 25 wt% of the polysilane.

In Formula (V), R12 represents a substituted or unsubstituted aryl group; typical examples are

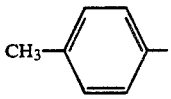
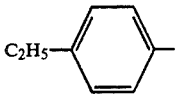
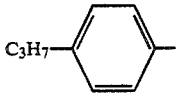
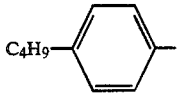
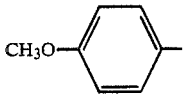
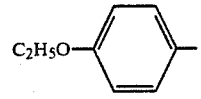

-continued

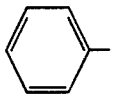

Typical examples of the compounds represented by Formula (V) and preferably used in the invention are as follows:

| No. | $R_{12}$ | $R_{13}$ |
|---|---|---|
| | $R_{12}-CH=C(R_{13})-COCOOH$ | |
| V-(1) | 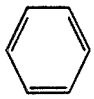 | H |
| V-(2) | 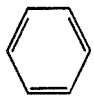 | Br |

-continued

| No. | $R_{12}$ | $R_{13}$ |
|---|---|---|
| V-(3) | 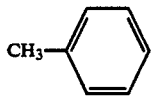 | Br |
| V-(4) | 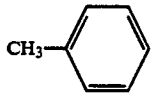 | H |
| V-(5) | 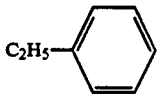 | H |
| V-(6) | 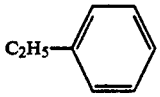 | Br |
| V-(7) | 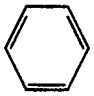 | Cl |
| V-(8) | 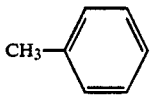 | Cl |
| V-(9) | 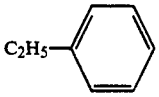 | Cl |
| | $R_{12}CH_2COCOOH$ | |
| V-(10) | 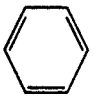 | |
| V-(11) | 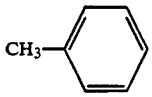 | |
| V-(12) | 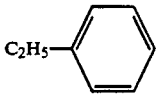 | |
| V-(13) | 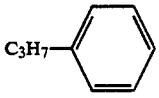 | |
| V-(14) | 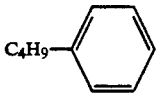 | |
| V-(15) | 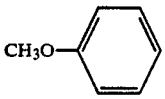 | |

The addition amount of the compounds represented by Formula (II) varies with the type of polysilanes, et., but usually 0.1 to 100 wt%, preferably 0.5 to 50 wt% and especially 1 to 25 wt% of the polysilane.

The degradation inhibitor represented by Formula (III), (IV) or (V) can be easily synthesized according to the methods described in literature such as Japanese Pat. O.P.I. Pub. Nos. 153553/1988, 159855/1988 and 163359/1988.

In Formula (VI), the halogen atom represented by $R_{16}$, $R_{17}$, $R_{18}$, or $R_{19}$ includes fluorine, chlorine. bromine and iodine; the alkyl group represented by $R_{14}$, $R_{15}$, $R_{16}$, $R_{17}$, $R_{18}$ or $R_{19}$, which may be straight-chained or branched, is preferably one having 1 to 32 carbon atoms; examples thereof include a methyl, ethyl, butyl, t-butyl, 2-ethylhexyl, 3,5,5-trimethylhexyl, 2,2-dimethylpentyl, octyl, t-octyl, dodecyl, sec-dodecyl, hexadecyl, octadecyl and eicosyl group; the alkenyl group may be straight-chained or branched and contains preferably 2 to 32 carbon atoms; examples thereof include an allyl, butenyl, octenyl and oleyl group; the cycloalkyl group is preferably a 5- to 7-membered one, examples thereof include a cyclopentyl, cyclohexyl and cycloheptyl group; the aryl group includes a phenyl and naphthyl group; the heterocyclic group is preferably a 5- or 6-membered one containing a nitogen, oxygen and/or sulfur atom, examples thereof include a furyl, pyranyl, tetrahydropyranyl, imidazolyl, pyronyl, pyrimidinyl, pyrazinyl, triazinyl, thienyl, quinolyl, oxazolyl, thiazolyl and pyridinyl group.

The alkoxy group represented by $R_{16}$, $R_{17}$, $R_{18}$ or $R_{19}$ is, for example, a methoxy, ethoxy, propoxy, t-buthoxy, hexyloxy, dodecyloxy, octadecyloxy or dococyloxy group; the alkylthio group is, for example, a methylthio, butylthio, octylthio, dodecylthio or dococylthio group; the aryloxy group is, for example, a phenoxy or naphthoxy group; the arylthio group is, for example, a phenylthio; the acyl group is, for example, an acetyl, butanoyl, octanoyl, dodecanoyl, benzoyl, cinnamoyl or naphthoyl group; the acylamino group is, for example, an acetylamino, octanoylamino or benzoylamino group; the alkylamino group is a mono or dialkylamino group such as a methylamino, ethylamino, diethylamino, isopropylamino, dioctylamino or didecylamino group; the alkoxycarbonyl group is, for example, a methoxycarbonyl, ethoxycarbonyl, nonyloxycarbonyl, hexadecyloxycarbonyl or dococyloxycarbonyl group; the sulfonamido group is, for example, a methylsulfonamido, octylsulfonamido or phenylsulfonamido group.

These groups may have a substituent such as a halogen atom or a hydroxyl, carboxyl, sulfo, cyano, alkyl (particularly one having 1 to 32 carbon atoms), alkenyl (particularly one having 2 to 32 carbon atoms), alkoxy, alylthio, alkenyloxy, alkenylthio, aryl, aryloxy, arylthio, arylamino, alkylamino, alkenylamino, acyl, acyloxy, acylamino, carbamoyl, sulfonamido, sulfamoyl, alkoxycarbonyl, aryloxycarbonyl or heterocyclic (particularly a 5- or 6-membered one having a nitrogen, oxygen and/or sulfur atom). These substituents may further have one of these substituents.

In Formula (VI), $R_{14}$ and $R_{15}$ each are preferably a straight-chain or branched alkyl or alkenyl group having 1 to 32 carbon atoms, and a substituent which the alkyl or alkenyl group may have is preferably a hydroxyl, cyano, carboxyl or aryl group, a halogen atom, an alkoxy group having 1 to 32 carbon atoms, an aryloxy group or an alkoxycarbonyl group having 1 to 32 carbon atoms; $R_{16}$, $R_{17}$, $R_{18}$ and $R_{19}$ each are preferably a hydrogen atom or a straight-chain or branched alkyl or alkenyl group having 1 to 32 carbon atoms, and a substituent of the alkyl or alkenyl group is preferably the same as that defined for $R_{14}$ and $R_{15}$. In the invention, it is particularly preferable that at least one of $R_{14}$ and $R_{15}$ be an alkyl group having 8 to 32 carbon atoms, and that at least two of $R_{16}$, $R_{17}$, $R_{18}$ and $R_{19}$ be alkyl or alkenyl groups and the other two be hydrogen atoms.

The following are typical examples of the degradation inhibitors represented by Formula (VI).

VI-1

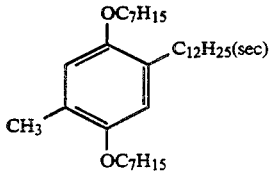

VI-2

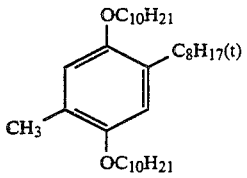

VI-3

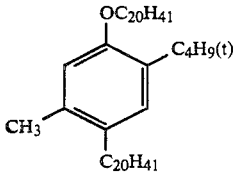

VI-4

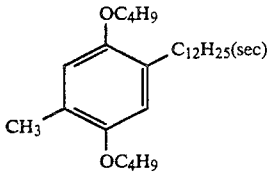

VI-5

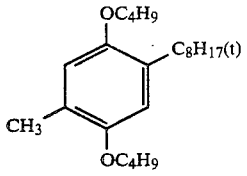

VI-6

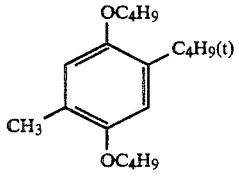

VI-7

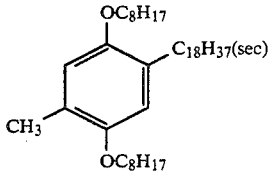

-continued

VI-8

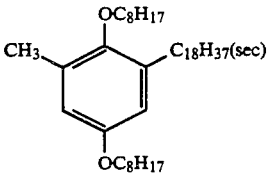

VI-9

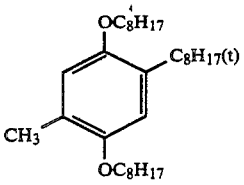

VI-10

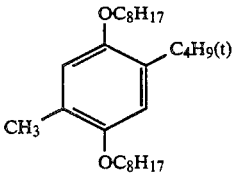

VI-11

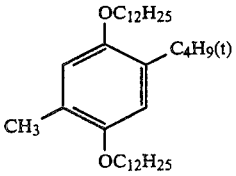

VI-12

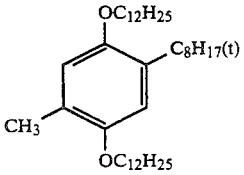

VI-13

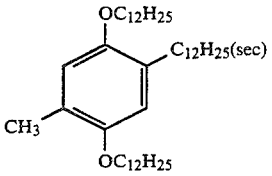

VI-14

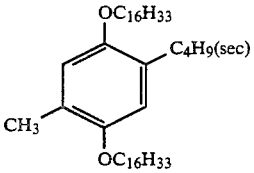

VI-15

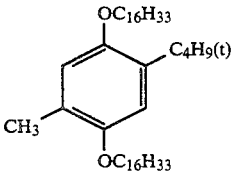

VI-16

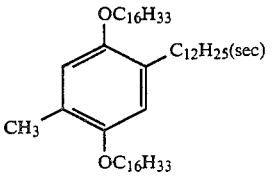

-continued
VI-17
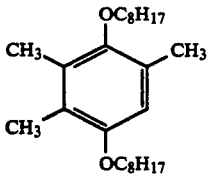
VI-18
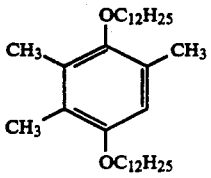
VI-19
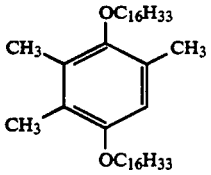
VI-20
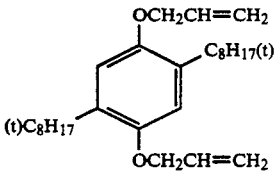
VI-21
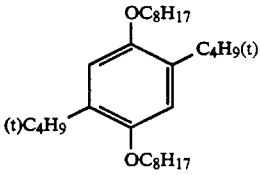
VI-22
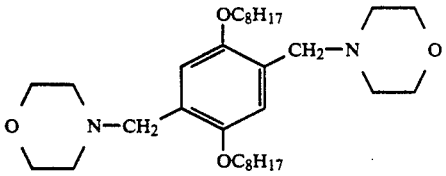
VI-23
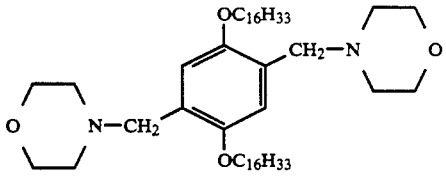
VI-24
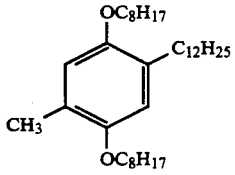
VI-25
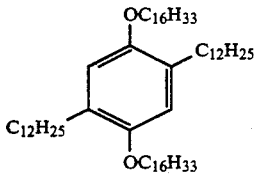
-continued
VI-26
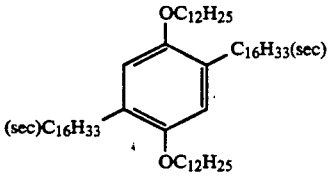
VI-27
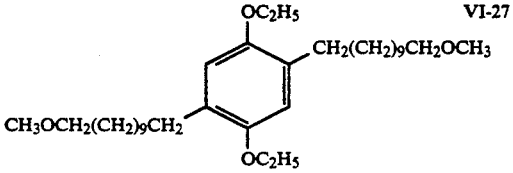
VI-28
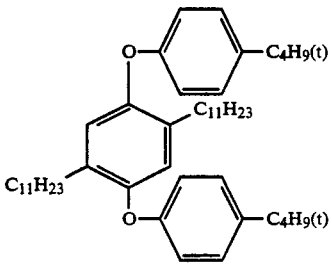
VI-29
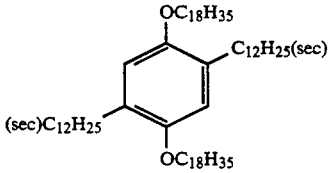
VI-30
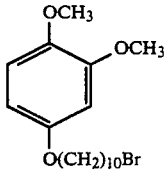
VI-31
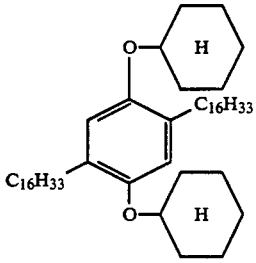
VI-32
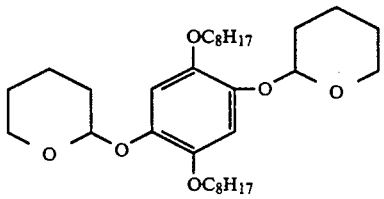

-continued
VI-33
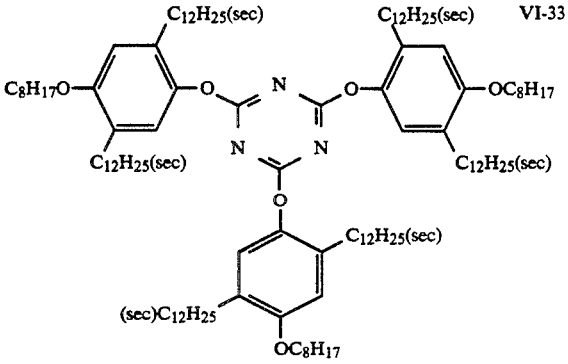
VI-34
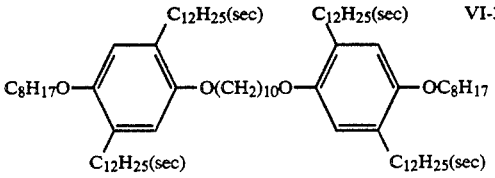
VI-35
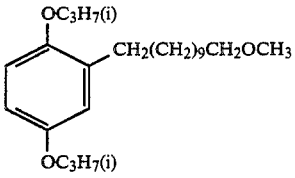
VI-36
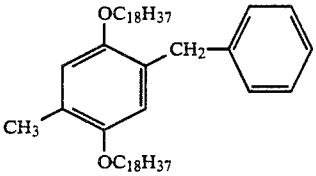
VI-37
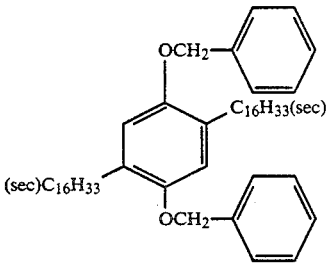
VI-38
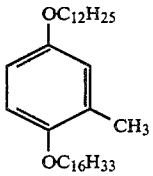
VI-39
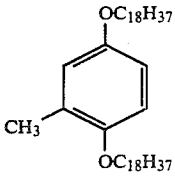
-continued
VI-40
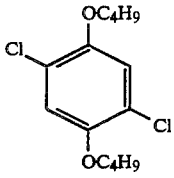
VI-41
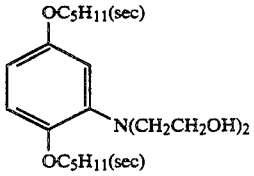
VI-42
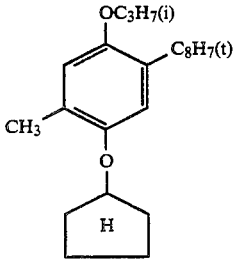
VI-43
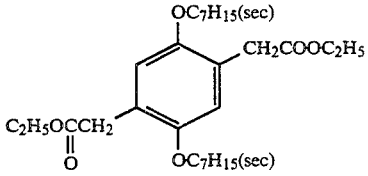
VI-44
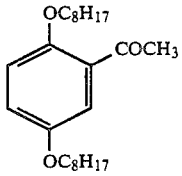
VI-45
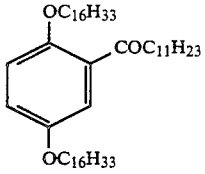
VI-46
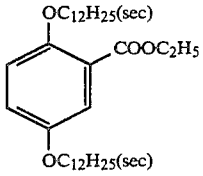
VI-47
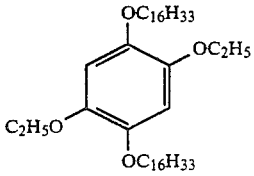

-continued

VI-48

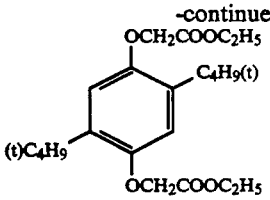

VI-49

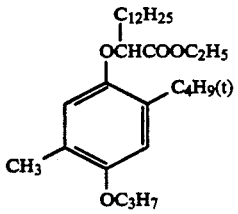

VI-50

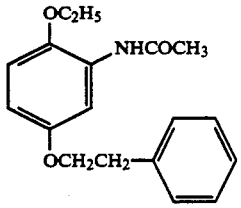

VI-51

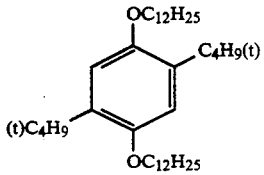

VI-52

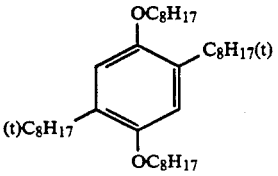

VI-53

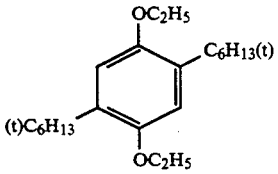

VI-54

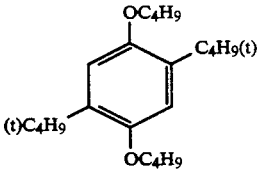

These compounds can be easily synthesized by the methods described in J. Chem. Soc., pp. 2904–2914 (1965) and J. Org. Chem., Vol. 23, pp. 75–76.

The addition amount of the compound represented by Formula (VI) used in the invention, though varies with layer configurations of photoreceptors and types of charge generation materials, is 0.1 to 100 wt%, preferably 0.5 to 50 wt% and especially 1 to 25 wt% of polysilane.

In Formula (VII), the alkyl group represented by R includes a methyl, ethyl, propyl, t-octyl, benzyl and hexadecyl group; the alkenyl group includes an allyl, octenyl and oleyl group; the aryl group includes a phenyl and naphthyl group; the heterocyclic group includes a tetrahydropyranyl and pyrimidinyl group; when R is a $R_{19}CO$—, $R_{20}SO_2$— or $R_{21}NHCO$— group, the alkyl, alkenyl, aryl and heterocyclic group represented by $R_{19}$, $R_{20}$ or $R_{21}$ are the same groups as those defined for the above R; the halogen atom represented by $R_{16}$ or $R_{17}$ is, for example, a fluorine, chlorine or bromine atom; the alkoxy group is, for example, a methoxy, ethoxy, butoxy or benzyloxy group; the alkenoxy group is, for example, a 2-propenyloxy or hexenoxy group; the alkyl and alkenyl group is the same groups as those defined for the above R; the alkyl, alkenyl and aryl group represented by $R_{18}$ are also the same groups as those defined for the above R. These alkyl, alkenyl, alkoxy, alkenoxy, aryl and heterocyclic groups may further have a substituent.

Typical examples of the compounds represented by Formula (VII) are as follows:

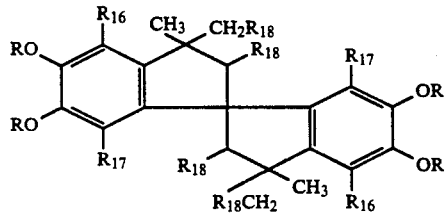

| Compounds | R | $R_{16}$ | $R_{17}$ | $R_{18}$ |
|---|---|---|---|---|
| IV-1 | $CH_3$ | H | H | H |
| IV-2 | $CH_3CO$ | H | H | H |
| IV-3 | $C_4H_9$ | H | $CH_3$ | H |
| IV-4 | 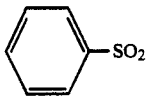 | H | H | H |
| IV-5 | $C_2H_5$ | H | H | H |
| IV-6 | $CH_3$ | H | H | $CH_3$ |
| IV-7 | $C_7H_{15}CO$ | H | H | H |
| IV-8 | $C_{12}H_{25}$ | H | H | H |
| IV-9 | $C_4H_9$ | H | H | H |
| IV-10 | $CH_3OCH_2CH_2$ | H | H | H |
| IV-11 | $C_5H_{11}$ | H | H | H |
| IV-12 | $CH_2{=}CHCH_2$ | H | H | H |
| IV-13 | $C_6H_{13}$ | H | H | H |
| IV-14 | $C_3H_7$ | H | H | 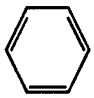 |
| IV-15 | $C_8H_{17}$ | H | H | H |
| IV-16 | $C_4H_9$ | H | $CH_3O$ | H |
| IV-17 | sec-$C_5H_{11}$ | H | H | H |
| IV-18 | $C_4H_9$ | H | H | $CH_3$ |
| IV-19 | $C_2H_5CO$ | H | H | H |
| IV-20 | $C_4H_9$ | H | H | $(CH_3)_2$ |
| IV-21 | $C_3H_7$ | H | H | H |
| IV-22 | $C_{18}H_{37}$ | H | H | H |
| IV-23 | 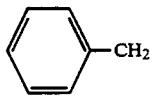 | H | H | H |
| IV-24 | $C_{10}H_{21}$ | H | H | H |

These compounds can be easily synthesized by a usual alkylation or esterification of a 5,6,5',6'-tetrahydroxy-1,1'-spirobiindane compound, which is synthesized according to the method described in J. Chem. Soc., p. 1678 (1934).

The addition amount of the compounds represented by Formula (VII) varies with the type of polysilanes, etc., but usually 0.1 to 100 wt%, preferably 0.5 to 50 wt% and especially 1 to 25 wt% of the polysilane.

In Formula (VIII), the alkyl group represented by R22 is, for example, a methyl, ethyl, propyl, i-propyl, butyl, t-butyl, i-pentyl, sec-pentyl, octyl, t-octyl, dodecyl, octadecyl or eicosyl group; the alkenyl group is, for example, an allyl, octenyl or oleyl group; the aryl group is, for example, a phenyl or naphthyl group; the alkoxy group is, for example, a methoxy, ethoxy, butoxy or dodecyloxy group; the alkenoxy group is, for example, an allyloxy or hexenyloxy group; the aryloxy group is, for example, a phenyloxy group.

The halogen atom represented by $R_{23}$ or $R_{24}$ is, for example, a fluorine, chlorine or bromine atom; the alkyl alkenyl and alkoxy group includes the same groups as those defined for the above $R_{22}$. The cycloalkyl group represented by $R^1$ is, for example, a cyclopentyl, cyclohexyl or cyclooctyl group; the heterocyclic group is, for example, an imidazolyl, furyl, thiazolyl, pyridinyl group; the alkyl and alkenyl group are the same groups as those defined for the above $R_{22}$.

The alkenyl and alkenyl group represented by $R^2$ are the same groups as those defined for the above $R_{22}$.

The alkyl and aryl group represented by $R_{25}$, $R_{26}$ or $R_{27}$ are the same groups as those defined for the above $R_{22}$; the cycloalkyl and heterocyclic group include the same groups as those defined for the above $R^1$.

These alkyl, alkenyl, aryl, alkoxy, alkenoxy, aryloxy, cycloalkyl and heterocyclic groups may have a substituent such as a halogen atom, or an alkyl, aryl, alkoxy, aryloxy, cyano, alkyloxy, alkoxycarbonyl, acyl, sulfamoyl, hydroxyl, nitro or amino group.

In the invention, the compounds represented by Formula (VIII) include the compounds represented by the following Formula (IX).

Formula (IX)

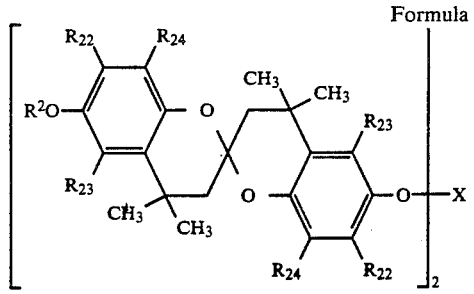

In Formula (IX), $R^2$, $R_{22}$, $R_{23}$ and $R_{24}$ are the same as those in Formula (VIII); X represents a substituted or unsubstituted alkylene group, an alkylene group linked to its carbon chain through —O—, —S—, —NA— (A is a hydrogen atom, a lower alkyl group or a phenyl group), $—SO_2—$ or a phenylene group, —CO—X'—CO—, $—SO_2—X'—SO_2—$ or —CONX—X'—NH-CO— (X' is an alkylene group, an alkylene group linked to its carbon chain through —O—, —S—, —NA— (A is a hydrogen atom, a lower alkyl group or a phenylene group) or $—SO_2—$, or a phenylene group).

In Formulas (VIII) and (IX), it is preferable that $R_{22}$ be a substituted or unsubstituted alkyl, alkenyl or aryl group and $R_{23}$ and $R_{24}$ each be a hydrogen atom or a substituted or unsubstituted alkyl group, provided that the substituent is the same as that described above.

In Formulas (VIII) and (IX), it is particularly preferable that $R_{22}$ be an alkyl group or a phenyl group allowed to have an alkyl substituent; $R_{23}$ and $R_{24}$ each be a hydrogen atom; $R^1$ be an alkyl group allowed to have a phenyl or alkoxycarbonyl substituent, an alkenyl group, a cycloalkyl group, a $R_{25}CO$ group, a $R_{26}SO_2$ group or a $R_{27}NHCO$ group; $R_{25}$, $R_{26}$ and $R_{27}$ each be an alkyl group or a phenyl group allowed to have an alkyl substituent; and X be an alkylene group or a —CO—X'—CO— group (X' is an alkylene group).

The following are typical examples of the compounds represented by Formula (VIII) or Formula (IX):

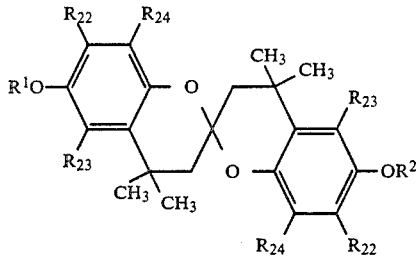

| Compounds | $R^1$ | $R^2$ | $R_{22}$ | $R_{23}$ | $R_{24}$ |
|---|---|---|---|---|---|
| VIII-1 | $CH_3$ | H | $CH_3$ | H | H |
| VIII-2 | $CH_2{=}CHCH_2$ | H | $CH_3$ | H | H |
| VIII-3 | $(t)C_5H_{11}$ | H | $CH_3$ | H | H |
| VIII-4 | 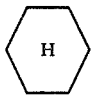 | H | $CH_3$ | H | H |
| VIII-5 | 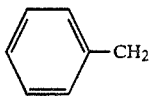 | H | $CH_3$ | H | H |

-continued
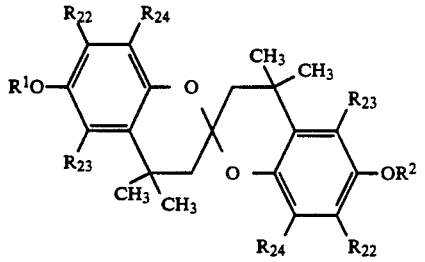
| Compounds | $R^1$ | $R^2$ | $R_{22}$ | $R_{23}$ | $R_{24}$ |
|---|---|---|---|---|---|
| VIII-6 | $C_4H_9$ | H | 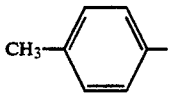 | H | H |
| VIII-7 | $CH_3CO$ | $CH_3CO$ | $CH_3$ | H | H |
| VIII-8 | 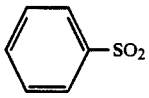 | H | $CH_3$ | H | H |
| VIII-9 | 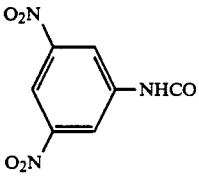 | H | $CH_3$ | H | H |
| VIII-10 | $(t)C_5H_{11}$ | $CH_3CO$ | $CH_3$ | H | H |
| VIII-11 | 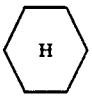 | $C_{11}H_{23}CO$ | $CH_3$ | H | H |
| VIII-12 | $C_8H_{17}$ | $C_5H_{11}CO$ | $CH_3$ | H | H |
| VIII-13 | 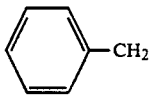 | 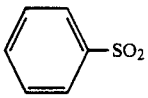 | $CH_3$ | H | H |
| VIII-14 | $CH_3CO$ | $CH_3CO$ | 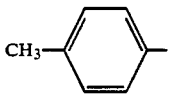 | H | H |
| VIII-15 | $(i)C_5H_{11}$ | $(i)C_5H_{11}$ | $CH_3$ | H | H |
| VIII-16 | $CH_2{=}CHCH_2$ | $CH_2{=}CHCH_2$ | $(t)C_4H_9$ | H | H |
| VIII-17 | $CH_3$ | $C_8H_{17}$ | $CH_3$ | H | H |
| VIII-18 | $C_4H_9$ | $C_4H_9$ | 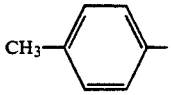 | H | H |
| VIII-19 | 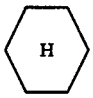 | $CH_3OCOCH_2$ | $CH_3$ | H | H |
| VIII-20 | 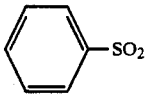 | 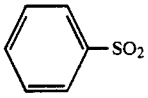 | $CH_3$ | H | H |

-continued

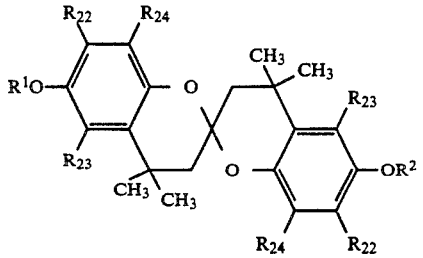

| Compounds | $R^1$ | $R^2$ | $R_{22}$ | $R_{23}$ | $R_{24}$ |
|---|---|---|---|---|---|
| VIII-21 | 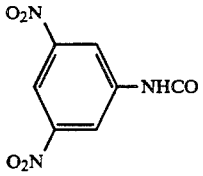 | 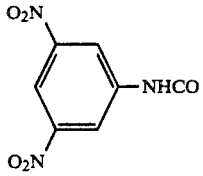 | $CH_3$ | H | H |
| VIII-22* | $CH_3CO$ | $-(CH_2)_3-$ | $CH_3$ | H | H |
| VIII-23* | $C_7H_{15}CO$ | $-COCH_2CO-$ | $CH_3$ | H | H |

Compounds bearing a * mark are of Formula (IX) type.

These compounds can be easily synthesized by alkylation or acylation of 6,6'-dihydroxy-4,4,4',4'-tetramethyl-2,2'-spirobichroman, which is obtained by the method disclosed in Japanese Pat. Exam. Pub. No. 20977/1974; relevant information can also be found in Japanese Pat. O.P.I. Pub. No. 20327/1978.

The addition amount of the compounds represented by Formula (VIII) and Formula (IX) varies with the type of polysilanes, et., but usually 0.1 to 100 wt%, preferably 0.5 to 50 wt% and especially 1 to 25 wt% of the polysilane.

The addition amount of the compounds represented by Formula (III), (IV), (V), (VI), (VII), (VIII) or (IX) varies with the layer configuration of photoreceptors and the type of charge transfer materials, but these are used in an amount of 0.1 to 100 wt%, preferably 0.5 to 50 wt% especially 1 to 25 wt% of a charge transfer material.

In the invention, particularly preferred degradation inhibitors are those represented by Formula (VI), Formula (VII) or Formula (VIII).

Suitable charge generator materials in the invention are, for example, azo pigments, polycyclic quinone pigments, squarium pigments, perylene pigments and phthalocyanine pigments. Among these, azo pigments, polycyclic quinone pigments and phthalocyanine pigments are preferred.

Azo pigments used in the invention are described in Japanese Pat. O.P.I. Pub. No. 179155/1989; examples thereof include those represented by one of the following Formulas (A) to (C).

Formula (A)

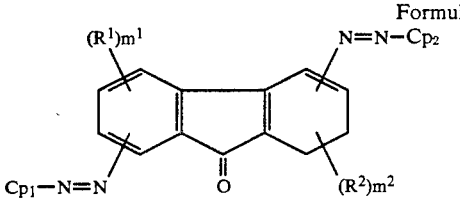

(In Formula (A), $Cp_1$ and $Cp_2$ each represent a coupler residue; $R^1$ and $R^2$ each represent a halogen atom, or an alkyl, alkoxy, nitro, cyano or hydroxyl group; $m^1$ and $m^2$ each represent an integer of 0 to 3, provided that $m^1$ $R^1$s and $m^2$ $R^2$s may be the same or different.)

Formula (B)

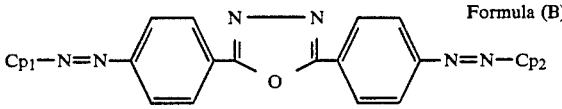

(In Formula (B), $Cp_1$ and $Cp_2$ each represent a coupler residue.)

Formula (C)

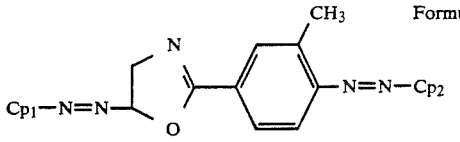

(In Formula (C), $Cp_1$ and $Cp_2$ each represent a coupler residue.)

Examples of the coupler residue represented by $Cp_1$ or $Cp_2$ in Formulas (A) to (C) include those expressed by one of the following Formulas (1) to (11), in which $Cp_1$ and $Cp_2$ may be the same or different.

(1)

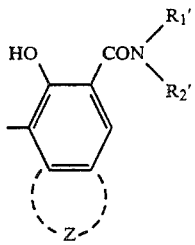

-continued (2)

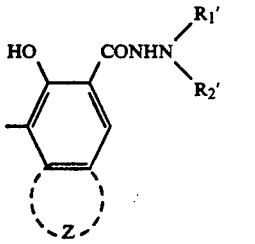

(3)

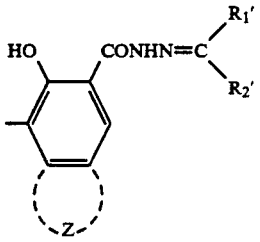

(4)

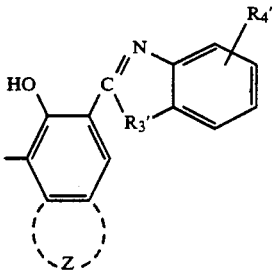

(5)

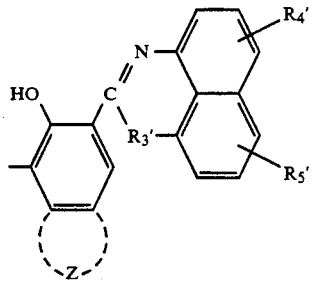

(6)

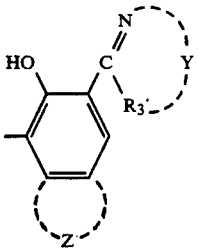

(7)

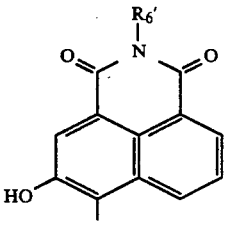

-continued (8)

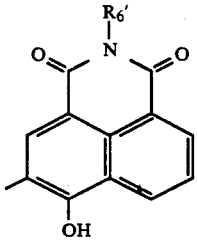

(9)

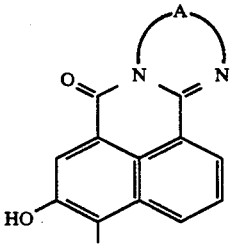

(10)

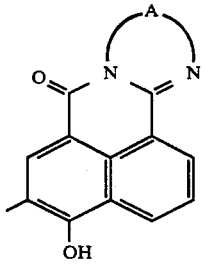

(11)

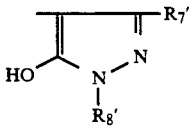

In the above Formulas, Z represents a group of atoms necessary to form a polycyclic aromatic ring or a heterocycle through condensation with a benzene ring.

$R_1'$ and $R_2'$ each represent a hydrogen atom, an alkyl group, an aralkyl group, an aryl group or a heterocyclic group, or a substituted one of these groups; these may form a ring together with a nitrogen or carbon atom. $R_3'$ represents —O—, —S— or —NH—. $R_4'$ and $R_5'$ each represents a hydrogen atom or a halogen atom, or an alkyl group, an alkoxy group, a nitro group, a cyano group or an acetyl group. Y represents a group of atoms necessary to form a 5- or 6-membered ring. A represents a divalent group consisting of a carbocyclo-aromatic ring or a heterocycloaromatic ring. $R_6'$ represents an alkyl group, an aralkyl group, an aryl group or a heterocyclic group, or a substituted one of these groups. $R_7'$ represents a hydrogen atom, or an alkyl group, a dialkylamino group, a diarylamino group, a diaralkylamino group, a carbamoyl group, a carboxyl group or a carboxylate group. $R_8'$ represents an aromatic group or a substituted aromatic group.

Examples of the aromatic ring represented by the above Z include benzene and naphthalene, examples of the heterocycle include indole, carbazole, benzofuran and dibenzofuran. Z may have a substituent selected from halogen atoms (e.g., fluorine, chlorine, bromine), alkyl groups (e.g., methyl, ethyl, propyl, butyl), alkoxy groups (e.g., methoxy, ethoxy, propoxy, btoxy) and nitro group.

Examples of the coupler residues represented by one of Formulas (1) to (11) include those exemplified as compound Nos. 1 to 15 on pages 72–75 of Japanese Pat. Appl. No. 277176/1990. Examples of the azo pigments favorably used in the invention include those exemplified on page 76 page of Japanese Pat. Appl. No. 277176/1990; typical examples thereof are illustrated below, but the scope of the invention is not limited to them.

-continued

Formula (F)

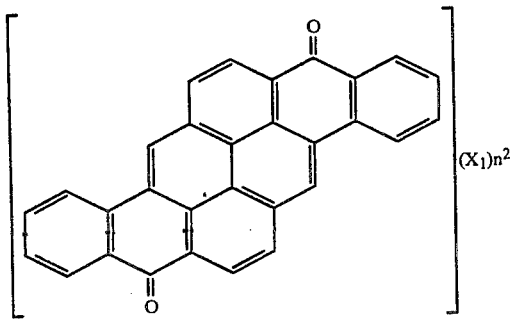

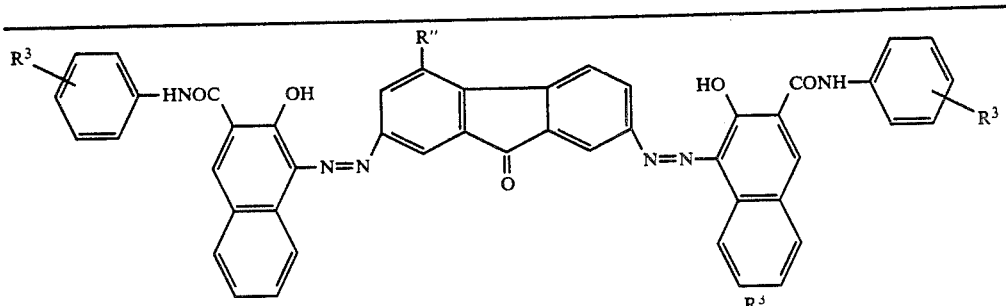

| R'' | R³ |
|---|---|
| H | p-Cl |
| H | m-Cl |
| H | o-Cl |
| Br | p-CF₃ |
| Br | m-CF₃ |
| Br | o-CF₃ |
| H | p-CF₃ |
| H | m-CF₃ |
| H | o-CF₃ |
| I | p-Cl |
| I | m-Cl |
| I | o-Cl |

Polycyclic quinone pigments usable in the invention are disclosed in Japanese Pat. O.P.I. Pub. No. 184349/1984. Examples thereof are those expressed by one of the following Formulas (D) to (F); of them, those expressed by (D) are particularly preferred.

Formula (D)

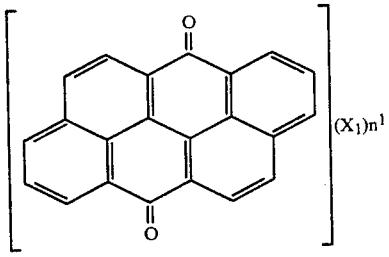

Formula (E)

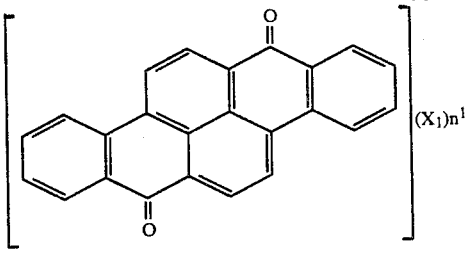

In Formulas (D) to (F), $X_1$ represents a halogen atom, or a nitro group, a cyano group, an acyl group or a carboxyl group; $n^1$ represents an integer of 0 to 4; and $n^2$ represents an integer of 0 to 6.

Typical examples of the polycyclic quinone pigments favorably used in the invention includes those exemplified as compounds (X-1) to (XII-1) and compounds 1 and 2 in Japanese Pat. Appl. No. 277176/1990.

Typical examples of the squarilium pigments usable in the invention include those expressed by the following Formula (G):

Formula (G)

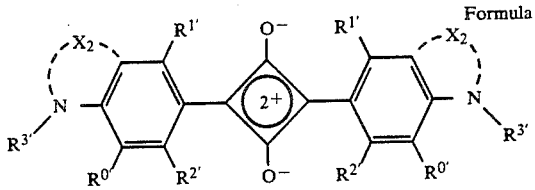

In Formula (G), $R^{0'}$, $R^{1'}$ and $R^{2'}$ each represent a hydrogen or halogen atom, an alkyl group, alkoxy group a phenyl group or a hydroxy group or NHY'; Y' represents

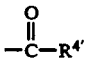

or $-SO_2R^{5'}$ ($R^{4'}$ and $R^{5'}$ each are an alkyl group which may have a substituent, a phenyl group or a hydrogen atom); $R^{3'}$ represents a substituted or unsubstituted alkyl group; and $X_2$ represent a group of atoms necessary to form an unsaturated monocyclic or polycyclic hydrocarbon.

Examples of the substituent for $R^{3'}$ include a halogen atom, or a hydroxyl, alkoxy, cyano, ester, acyl, dialkylamino, diaralkylamino, diarylamino or aryl group.

Typical examples of the squarilium pigments favorably used in the invention include those exemplified as compounds XIII-1 to XIII-13 on pages 83–84 of Japanese Pat. Appl. No. 277176/1990.

Typical examples of the perylene pigments favorably used in the invention include those exemplified as compound Nos. P-1 to P-9. on pages 86–87 of Japanese Pat. Appl. No. 277176/1990.

As the phthalocyanine pigment, there can be used metal or nonmetal phthalocyanine pigments. More specifically, there are favorably used $\chi$-type and $\tau$-type nonmetal phthalocyanines, and copper phthalocyanines or titanylphthalocyanines of $\alpha$-type and $\beta$-type as well. Titanylphthalocyanines favorably used in the invention are those represented by the following Formula (H), and particulars thereof are described in Japanese Pat. O.P.I. Pub. No. 35246/1991.

Formula (H)

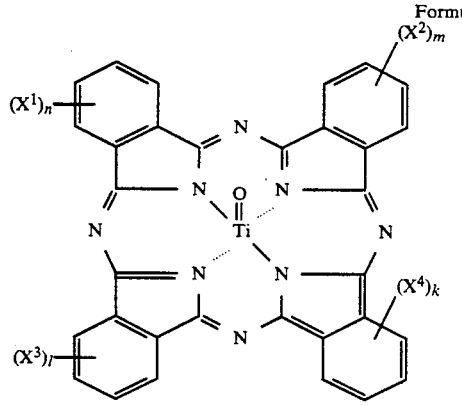

In Formula (H), $X^1$, $X^2$, $X^3$ and $X^4$ each represent a hydrogen atom, halogen atom or an alkyl group or an alkoxy group; and n, m, l and k each represent an integer of 0 to 4.

Titanylphthalocyanine pigments have a crystal structure which provides, in an X-ray diffraction spectrum with a Cu-K$\alpha$ radiation (wavelength: 1.541 Å), characteristic peaks at Bragg angles ($2\theta$) of at least 9.6°±0.2° and 27.2°±0.2°, and the peak intensity at 9.6°±0.2° is not less than 40% of that at 27.2°±0.2°.

In the invention, preferred titanylphthalocyanines are those having a crystal structure whose peak intensity at 9.6°±0.2° is not less than 60% of that at 27.2°±0.2°, or those having a crystal structure whose peak intensity at 9.6°±0.2° is not less than 50% of that at 27.2°±0.2 and whose peak intensity at 6.7°±0.2° is not more than 30% of that at 27.2°±0.2°.

The X-ray diffraction spectrum is determined under the following conditions, and "characteristic peak" used here is a gimlet-shaped projection of acute angle which is distinctly different from noises.

| | | |
|---|---|---|
| X-ray vessel | | Cu |
| Voltage | 40.0 | KV |
| Current | 100 | mA |
| Start angle | 6.0 | deg |
| Stop angle | 35.0 | deg |
| Step angle | 0.02 | deg |
| Measurement time | 0.50 | sec |

These titanylphthalocyanines can be prepared by a generally known method. One preparation method, though not limited to it, comprises the steps of allowing titanium tetrachloride and phthalodinitrile to react in an inactive high boiling solvent such as $\alpha$-chloronaphthalene at 160° to 300° C., generally 160° to 260° C., and hydrolyzing the resulting dichlorotitanium phthalocyanine with a base or water to give a titanylphthalocyanine.

Further, there can be adopted another favorable synthesizing method which uses an alkoxytitanate, the so-called titanium coupling agent.

Usable coupling agents are those represented by the following Formula (T):

Formula (T)

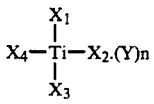

In Formula (T), $X_1$, $X_2$, $X_3$ and $X_4$ each represent $OR_1$,—$SR_2$, —$OS_2R_3$

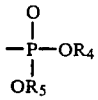

($R_1$ to $R_5$ each are a hydrogen atom, an alkyl, alkenyl, aryl, aralkyl, acyl, aryloyl or heterocyclic group, each may have a substituent), provided that $X_1$ to $X_4$ may be linked to each other to form a ring; Y represents a ligand; and n represents 0, 1 or 2.

In the invention, those of which $X_1$ to $X_4$ are —$OR_1$ groups are preferred for their advantages in reactivity, easiness in handling and prices.

Typical examples of the titanium coupling agents favorably used in the invention are shown below:

$(C_4H_9)_4Ti$ (T-1)

$(i\text{-}C_3H_7O)_4Ti$ (T-2)

$(C_2H_5)_4Ti$ (T-3)

$(i\text{-}C_4H_9O)_4Ti$ (T-4)

$(C_{18}H_{37})_4Ti$ (T-5)

$(C_3H_7O)_4Ti$ (T-6)

$(i\text{-}C_3H_7O)_2Ti(CH_3COCHCOCH_3)_2$ (T-7)

$(HOCO\underset{\underset{CH_3}{|}}{C}HO)_2Ti(OH)_2$ (T-8)

-continued (T-9)

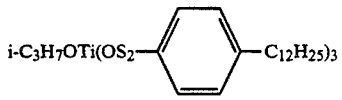

(T-10)

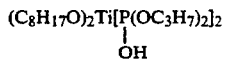

Using a titanium coupling agent, a titanylphthalocyanine can be synthesized according to the following reaction equation. This method is substantially free from side reactions and thereby excellent in capability of easily providing a product in high purity.

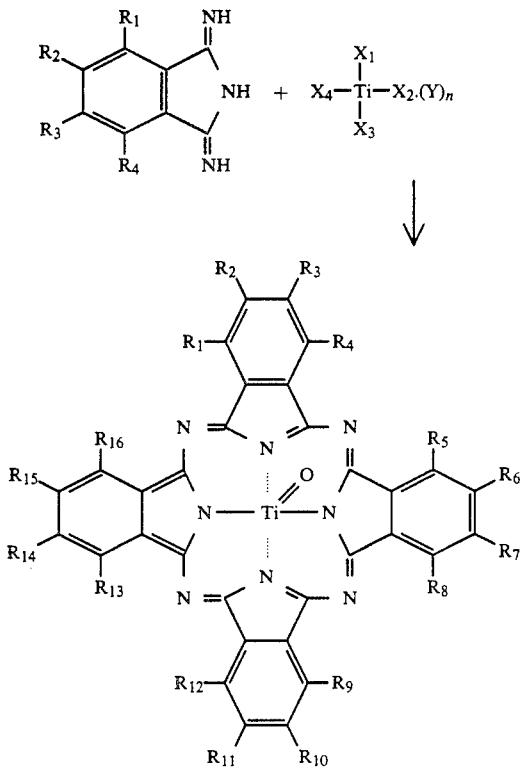

In the formula, $R_1$ to $R_{16}$ each represent a hydrogen atom, a halogen atom, an alkyl group or an alkoxy group.

A crystalline product can be obtained, for example, by treating, in an organic solvent immiscible with water, a hydrolyzed titanylphthalocyanine, or an amorphous titanylphthalocyanine obtained by being dissolved in sulfuric acid and then poured in water. In carrying out this treatment, there can be used a homomixer, disperser, agitator, ball mill, sand mill or attritor, besides a general stirring apparatus In the invention, there can be added, when necessary, a charge transfer material (hereinafter referred to as a CTM) represented by the following Formula (a), (b), (c), (d) or (e). Particulars of these compounds are described in Japanese Pat. Appl. No. 277176/1990.

Formula (a)

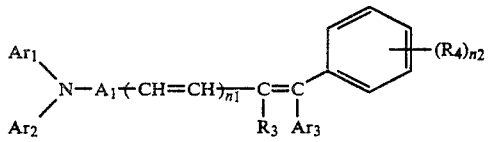

(In the formula, $R_3$ represents a hydrogen atom, an alkyl group or an aryl group; $R_4$ represents a substituent; $A_1$ represents a phenylene group or a naphthylene group; $Ar_1$ and $Ar_2$ each represents an alkyl group, a phenyl group or a naphthyl group; $Ar_3$ represents a hydrogen atom, a phenyl group or a naphthyl group; $n_1$ represents 0 or 1; and $n_2$ represents an integer of 0 to 5.)

Formula (b)

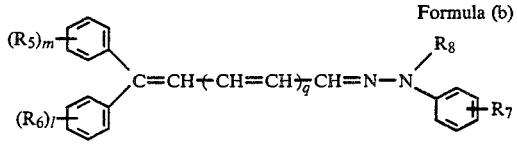

(In the invention, $R_5$, $R_6$ and $R_7$ each represent a hydrogen atom, an alkyl group, an alkoxy group or an aryloxy group; $R_8$ represents a hydrogen atom, an alkyl group, an alkenyl group or an aryl group; m and 1 each represent 1 or 2; q represents 0 or 1; $R_5$ and $R_6$ may be the same with, or different to, each other, provided that m and 1 are 2.)

Formula (c)

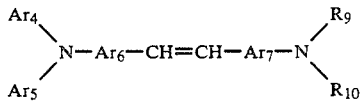

(In the formula, $Ar_4$ and $Ar_5$ each represent an aryl group; $Ar_6$ represents an arylene group; $Ar_7$ represents a p-phenylene group or a naphthylene group; $R_9$ and $R_{10}$ each represents an alkyl group.)

Formula (d)

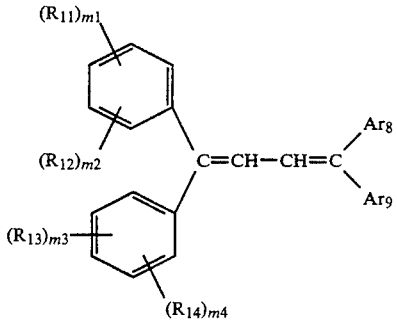

(In the formula, $R_{11}$ and $R_{13}$ each represent a dialkylamino group; $R_{12}$ and $R_{14}$ each represent a halogen atom or a cyano group; $Ar_8$ and $Ar_9$ each represent a phenyl group or a naphthyl group; and $m_1$, $m_2$, $m_3$ and $m_4$ each represent 0 or 1, provided that $m_1$ and $m_3$ are not 0 concurrently.)

Formula (e)

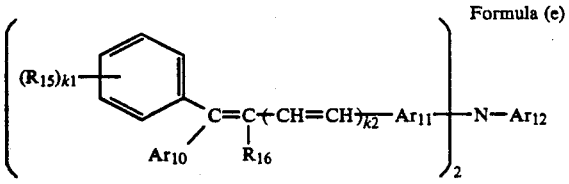

(In the formula, $R_{15}$ represents a hydrogen atom or a subsistent; $R_{16}$ represents a hydrogen atom an alkyl group or an aryl group; $Ar_{10}$ represents a hydrogen atom a benzyl group, a phenyl group or a naphthyl group; $Ar_{11}$ represents a phenylene group or a naphthylene group; $Ar_{12}$ represents an alkyl group, a phenyl group or a naphthyl group; $k_1$ represents an integer of 0 to 5; and k2 represents 0 or 1.)

The electrophotographic photoreceptor of the invention usually has configurations shown by FIGS. (A) to (D). In FIGS. (A) and (B), there is provided, on conductive support 1, photosensitive layer 4A or 4B each comprised of a laminated body of charge generation layer 2 containing a charge generation material and charge transfer layer 3 containing a polysilane and, when necessary, a charge transfer material; in these configurations, charge generation layer 2 and charge transfer layer 3 are laminated in different orders. As shown in FIGS. (C) and (D), photosensitive layer 4A or 4B may be provided on conductive layer 1 via an intermediate layer 5, such as an adhesive layer or a barrier layer. Further, a protective layer may be provided as the outermost layer. In the invention, the charge generation layer may contain a charge transfer material besides a charge generation material.

The binder resin used in the photosensitive layer, the protective layer and the intermediate layer may be arbitrarily selected. Examples thereof include addition polymerization resins, polyadditon resins, polycondensation resins and copolymer resins containing two or more of repeating units of these resins, such as polystyrenes, polyethylenes, polypropylenes, acrylic resins, methacrylic resins, polyvinyl chloride resins, polyvinyl acetate resins, polyvinyl butyral resins, epoxy resins, polyurethane resins, phenol resins, polyester resins, alkyd resins, polycarbonate resins, silicone resins and melamine resins. Besides these insulating resins, there can also be used high molecular organic semiconductors such as poly-N-vinylcarbazoles.

As a conductive support to bear the photosensitive layer, there can be used plates or drums of metals such as aluminium, nickel; plastic films on which metal foil is laminated or aluminium, tin oxide or indium oxide is deposited; paper, plastic films or plastic drums, which are coated with a conductive material.

In the invention, the charge generation layer is typically provided by coating and drying a dispersion prepared through dispersing the above charge generation material and, when necessary, the charge transfer material singly or in combination with a binder resin in a suitable dispersion medium on a support, a subbing layer or a charge transfer layer by means of, for example, dip coating, spray coating, blade coating or roll coating. In the invention, dispersing of a charge generation material can be carried out by use of a ball mill, homomixer, sand mill, supersonic disperser or attriter.

Dispersion media usable in the invention are, for example, hydrocarbons such as hexane, benzene, toluene, xylene; halogenated hydrocarbons such as methylene chloride, 1,2-dichloroethane, sym-tetrachloroethane, 1,1,2-trichloroethane, chloroform; ketones such as acetone, methyl ethyl ketone, cyclohexanone; esters such as ethyl acetate, butyl acetate; alcohols and derivatives thereof such as methanol, ethanol, propanol, butanol, cyclohexanol, heptanol, ethylene glycol, methyl cellosolve, ethyl cellosolve, cellosolve acetate; ethers and such as tetrahydrofuran, 1,4-dioxane, furan, furfural; acetals; and nitrogen compounds such as amines including pyridine, butylamine, diethylamine, ethylenediamine, isopropanolamine and amides including N,N-dimethylformamide.

When the photoreceptor of the invention has a laminated structure, the weight ratio of binder:charge-generation-material:charge-transfer-material in the charge generation layer is preferably 0 to 100:1 to 500:0 to 500. A ratio of the charge generation material smaller than this causes a low sensitivity and an increase in residual potential, and a ratio larger than this lowers dark decay and acceptance potential.

The thickness of the charge generation layer formed as above is preferably 0.01 to 10 μm, especially 0.1 to 5 μm.

In the invention, a charge transfer layer can be formed by coating and drying a dispersion prepared through dispersing the polysilane and, when necessary, the charge transfer material in a suitable dispersion medium singly or in combination with the binder. As a dispersion medium, one used to disperse the charge generation material can be employed.

In the invention, the polysilane and the charge transfer material used when necessary are added in an amount of preferably not less than 40%, especially not less than 60% of the total weight of the charge transfer layer.

The thickness of the charge transfer layer is preferably 5 to 50 μm, especially 5 to 30 μm.

In the invention, an intermediate layer can be formed by steps of dissolving the binder and, if necessary, other additives in an alcohol such as methanol, ethanol or butanol, or in a different solvent such as toluene, and coating the solution on a substrate by a method selected from dip coating, roll coating, spray coating, wire bar coating, bead coating and curtain coating. The binder used in the intermediate layer may be the same as that used in the charge generation layer. The thickness of the intermediate layer is generally 0.1 to 5 μm, preferably 0.5 to 3 μm. The amount of the binder used is preferably 1 to 5 wt% of the solvent used.

In order to improve printing durability, a protective layer (a protective film) may be provided on the surface of the photoreceptor of the invention; for example, a synthetic resin may be coated to form a filmy layer.

In the invention, the charge generation layer may contain one or more types of electron accepting materials to improve sensitivity and minimize residual potential, or fatigue in duty-cycle operation. The addition amount of such electron accepting materials, given by a weight ratio of charge-generation-material:electron-accepting-material, is preferably 100:0.1 to 100 and especially 100:0.1 to 50.

Electron accepting materials usable in the photoreceptor of the invention are, for example, succinic anhydride, maleic anhydride, dibromomaleic anhydride, phthalic anhydride, tetrachlorophthalic anhydride, tetrabromophthalic anhydride, 3-nitrophthalic anhydrice, 4-nitrophthalic anhydride, pyromellitic anhydride, mellitic anhydride, tetracyanoethylene, tetracyanoquinodimethane, o-dinitrobenzene, m-dinitrobenzene, 1,3,5-trinitrobenzene, p-nitrobenzonitrile, picryl chloride, quinone chloroimide, chloranil, bromanil, 2-methylnaphthoquinone, dichlorodicyano-parabenzoquinone,anthraquinone, dinitroanthraquinone, trinitrofluorenone, 9-fluorenilidene[dicyanomethylene malonodinitrile], polynitro-9-fluorenilidene-[dicyanomethylene malonodinitrile], picric acid, o-nitrobenzoic acid, p-nitrobenzoic acid, 3,5-dinitrobenzoic acid, pentafluorobenzoic acid, 5-nitrosalicyclic acid, 3,5-dinitrosalicyclic acid and phthalic acid.

Further, a silicone oil may be employed in the photoreceptor of the invention as a surface modifier. An ammonium compound may be contained to improve durability. In addition, a dye for correcting color response may be added according to a specific requirement.

As light sources for the photoreceptor of the invention, there can be used halogen lamps, fluorescent lamps, tungsten lamps, gas lasers such as argon lasers and helium lasers, semiconductor lasers and LEDs.

EXAMPLES

The present invention is hereunder described in detail with examples. Every "parts" in the following examples is "parts by weight" unless otherwise indicated.

EXAMPLE 1-(1)

Photoreceptor sample Nos. 1 to 11

On a conductive support consisting of an aluminium deposited polyethylene terephthalate base was formed a 0.1-μm thick intermediate layer comprised of vinyl chloride-vinyl acetate-maleic anhydride copolymer Eslec MF-10 (product of Sekisui Chemical Co.).

A coating solution was prepared by dispersing 1 part of 4,10-dibromoanthanthrone expressed by the following formula (CGM-1) (Monolite Red 2Y made by ICI Ltd.), 0.5 part of polycarbonate resin Panlite L-1250 (product of Teijin Kasei Co.) and 1.0 part of charge transport material CTM-I in 100 parts of 1,2-dichloroethane for 24 hours in a ball mill. Then, the solution was coated on the above intermediate layer by the dipping method to form a charge generation layer having a dry thickness of 0.5μm.

Subsequently, a coating solution for the charge transport layer was prepared by mixing a polysilane and a degradation inhibitor with toluene (polysilane+degradation inhibitor/toluene =15W/V%), and the solution was coated on the above charge generation layer to give a charge transport layer having a dry thickness of 20μm. Electrophotographic photoreceptor sample Nos. 1 to 11 were prepared by repeating the above procedure. The polysilane and the degradation inhibitor were used as shown in Table 1.

Each of sample Nos. 1 to 11 was evaluated by use of a modified Konica 1550MR made by Konica Corp. The initial black original copying electric potential $V_{BO}$, the initial white original copying electric potential $V_{WO}$, initial residual electric potential $V_{RO}$ were determined to evaluate the sensitivity. After carrying out a 100,000-cycle copying test, black original copying electric potential $V_B$, white original copying electric potential $V_W$, residual electric potential $V_R$ were determined. In addition, the term "black original copying electric potential" used in above implies the surface electric potential of the photoreceptor obtained when a black paper having a reflection density of 1.3 was used as an original to make the above copying cycle, and the term "white original copying electric potential implies the surface electric potential of the same photoreceptor obtained when a white paper is used. The results are shown in Table 1.

CTM-I

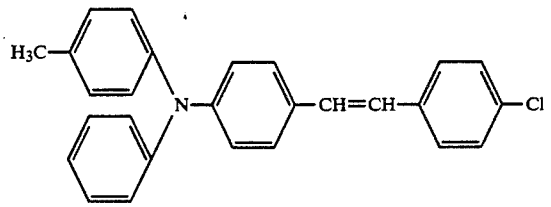

CGM-1

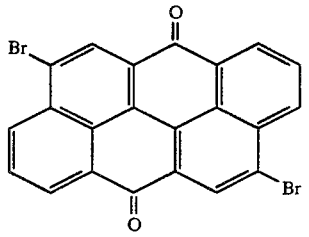

Polysilane (I)

I Polyphenylmethylsilane (Exemplified No. 18)

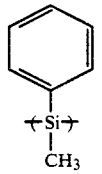

Ip = 5.62
molecular weight MN = $7.0 \times 10^3$
Mw = $4.0 \times 10^5$

II Polypropylmethylsilane (Exemplified No. 1)

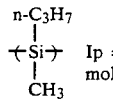

Ip = 5.77
molecular weight MN = $7.0 \times 10^3$
Mw = $2.5 \times 10^5$

III Polycyclohexylmethylsilane (Exemplified No. 8)

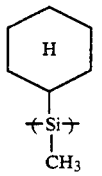

Ip = 5.92
molecular weight MN = $8.0 \times 10^3$
Mw = $3.0 \times 10^5$

Polysilane (II)

PI-1

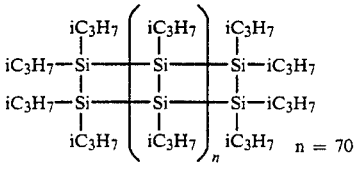

PI-2

-continued

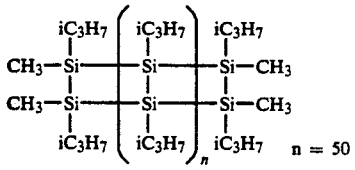

PI-3

-continued

AO-1 TINUVIN 320 (product of Ciba-Geigy AG)

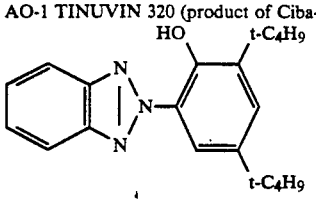

TABLE 1

| Sample No | Kind of Polysilane | Degradation Inhibitor Kind | Degradation Inhibitor Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 1 | No. 18 | III-(1) | 3.0 | 600 | 50 | 10 | 610 | 60 | 15 | Invention |
| 2 | No. 1 | III-(1) | 3.0 | 600 | 50 | 10 | 610 | 55 | 10 | Invention |
| 3 | No. 8 | III-(1) | 3.0 | 600 | 45 | 5 | 605 | 55 | 10 | Invention |
| 4 | PI-1 | III-(1) | 3.0 | 600 | 60 | 10 | 610 | 65 | 15 | Invention |
| 5 | PI-2 | III-(1) | 3.0 | 600 | 55 | 10 | 610 | 65 | 15 | Invention |
| 6 | PI-3 | III-(1) | 3.0 | 600 | 50 | 10 | 610 | 60 | 15 | Invention |
| 7 | No. 1 | III-(1) | 50.0 | 600 | 80 | 10 | 605 | 85 | 15 | Invention |
| 8 | No. 18 | III-(3) | 3.0 | 600 | 50 | 10 | 610 | 60 | 15 | Invention |
| 9 | No. 18 | — | — | 600 | 40 | 5 | 650 | 130 | 100 | Comparison |
| 10 | PI-1 | — | — | 600 | 45 | 5 | 660 | 135 | 105 | Comparison |
| 11 | No. 18 | AO-1 | 3.0 | 600 | 60 | 10 | 630 | 110 | 70 | Comparison |

*given in wt % of polysilane

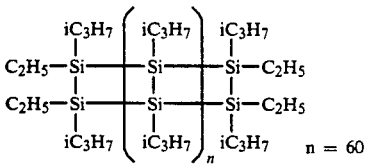

Degradation inhibitors (invention)

III-(1)

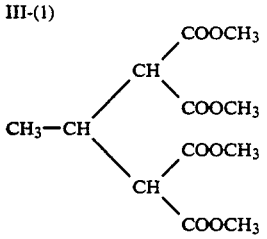

III-(3)

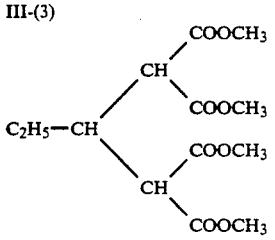

Degradation inhibitor (for comparison)

As apparent from Table 1, the samples of the invention gave satisfactory results in all the black original copying electric potential, white original copying electric potential and residual electric potential, at the initial stage and after the 100,000-cycle copying.

EXAMPLE 1-(2)

Photoreceptor sample Nos. 12 to 22 were prepared and evaluated in the same procedure as in Example 1-(1), except that the type of degradation inhibitors was changed as shown in Table 2. The results are summarized in Table 2.

Degradation inhibitors (invention)

IV-(2)

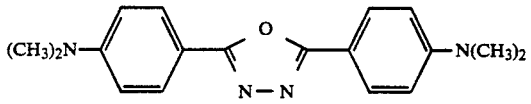

IV-(6)

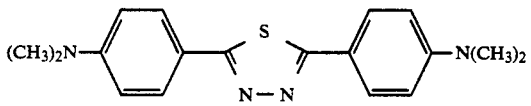

Degradation inhibitor (for comparison)

The same as that used in Example 1-(1)

Polysilanes: the same as those used in Example 1-(1)

TABLE 2

| Sample No | Kind of Polysilane | Degradation Inhibitor Kind | Degradation Inhibitor Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 12 | No. 18 | IV-(2) | 3.0 | 600 | 50 | 10 | 610 | 60 | 15 | Invention |
| 13 | No. 1 | IV-(2) | 3.0 | 600 | 45 | 10 | 610 | 55 | 15 | Invention |
| 14 | No. 8 | IV-(2) | 3.0 | 600 | 50 | 10 | 610 | 60 | 15 | Invention |
| 15 | PI-1 | IV-(2) | 3.0 | 600 | 50 | 10 | 610 | 60 | 15 | Invention |
| 16 | PI-2 | IV-(2) | 3.0 | 600 | 45 | 10 | 610 | 55 | 15 | Invention |
| 17 | PI-3 | IV-(2) | 3.0 | 600 | 55 | 10 | 610 | 65 | 15 | Invention |
| 18 | No. 18 | IV-(2) | 50.0 | 600 | 85 | 20 | 605 | 90 | 25 | Invention |
| 19 | No. 18 | IV-(6) | 3.0 | 600 | 50 | 10 | 610 | 60 | 15 | Invention |
| 20 | No. 18 | — | — | 600 | 40 | 5 | 650 | 135 | 105 | Comparison |
| 21 | PI-1 | — | — | 600 | 45 | 5 | 655 | 140 | 110 | Comparison |
| 22 | No. 18 | AO-1 | 3.0 | 600 | 50 | 10 | 630 | 105 | 75 | Comparision |

*given in wt % of polysilane

As seen in Table 2, the samples of the invention gave satisfactory results in all the black original copying electric potential, white original copying electric potential and residual electric potential, at the initial stage and after the 100,000-cycle copying.

EXAMPLE 1-(3)

Photoreceptor sample Nos. 23 to 33 were prepared and evaluated in the same procedure as in Example 1-(1), except that the type of degradation inhibitors was changed. The results are summarized in Table 3. The polysilane and the degradation inhibitor were used as shown in Table 3.

Degradation inhibitors (invention)

V-(1)

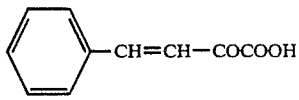

V-(3)

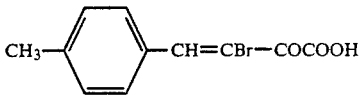

Degradation inhibitor (for comparison)

The same as that used in Example 1 (1)

Polysilanes: the same as those used in Example 1-(1)

TABLE 3

| Sample No | Kind of Polysilane | Degradation Inhibitor Kind | Degradation Inhibitor Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 23 | No. 18 | V-(1) | 3.0 | 600 | 50 | 10 | 610 | 60 | 15 | Invention |
| 24 | No. 1 | V-(1) | 3.0 | 600 | 50 | 10 | 610 | 60 | 15 | Invention |
| 25 | No. 8 | V-(1) | 3.0 | 600 | 45 | 10 | 610 | 55 | 15 | Invention |
| 26 | PI-1 | V-(1) | 3.0 | 600 | 55 | 10 | 610 | 65 | 15 | Invention |
| 27 | PI-2 | V-(1) | 3.0 | 600 | 50 | 10 | 610 | 60 | 15 | Invention |
| 28 | PI-3 | V-(1) | 3.0 | 600 | 55 | 10 | 610 | 55 | 15 | Invention |
| 29 | No. 18 | V-(1) | 50.0 | 600 | 85 | 20 | 605 | 90 | 25 | Invention |
| 30 | No. 18 | V-(3) | 3.0 | 600 | 55 | 10 | 610 | 65 | 15 | Invention |
| 31 | No. 18 | — | — | 600 | 40 | 5 | 655 | 140 | 105 | Comparison |
| 32 | PI-1 | — | — | 600 | 45 | 5 | 650 | 135 | 105 | Comparison |
| 33 | No. 18 | AO-1 | 3.0 | 600 | 50 | 10 | 630 | 100 | 80 | Comparison |

*given in wt % of polysilane

As apparent from Table 3, the samples of the invention gave satisfactory results in all the black original copying electric potential, white original copying electric potential and residual electric potential, before and after the 100,000-cycle copying.

EXAMPLE 2-(1)

Preparation of photoreceptor sample Nos. 34 to 44

A 0.1-μm thick intermediate layer consisting of nylon copolymer X 1874M (DAICEL-HÜLS LTD) was formed on a conductive support made of an aluminium deposited polyethylene terephthalate base.

A 0.4-μm thick charge generation layer was formed on the intermediate layer by coating, in a dipping mode, a solution prepared by dispersing 1 part of a bisazo pigment represented by the following structural formula, 0.5 part of polycarbonate resin Panlite L-1300 (product of Teijin Kasei Co.) and 1.0 part of charge transport material CTM-II in 100 parts of tetrahydrofuran in a ball mill for 24 hours.

Subsequently, a 20-μm thick charge transport layer was formed on the charge generation layer by coating a solution prepared using the above polysilane and degradation inhibitor as shown in Table 4. By repeating the above procedure, electrophotographic photoreceptor sample Nos. 34 to 44 were obtained. In preparing the above coating solution, the polysilane and the degradation inhibitor were dissolved in THF (polysilane + degradation inhibitor = 15W/V%) and no binder resin was used.

Sample Nos. 34 to 44 were evaluated using a modified Konica 5570MR made by Konica Corp. Initial black original copying electric potential $V_{BO}$, initial white original copying electric potential $V_{WO}$, initial residual electric potential $V_{RO}$ were determined and the sensitivity was evaluated. After carrying out a 100,000-cycle copying test, black original copying electric potential $V_B$, white original copying electric potential $V_W$, residual electric potential $V_R$ were determined. The results are shown in Table 4.

Bisazo dye:

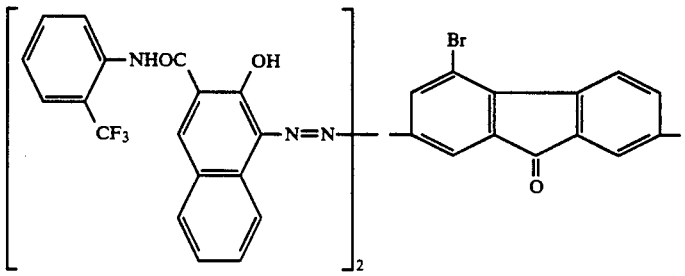

CTM-II

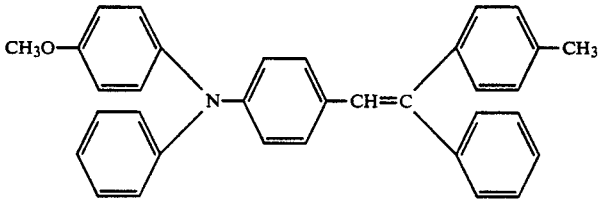

Degradation inhibitors (invention)

III-(1)

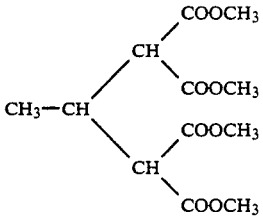

III-(3)

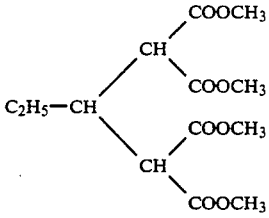

Degradation inhibitor (for comparison)

AO-1 TINUVIN 320 (product of Ciba-Geigy AG)

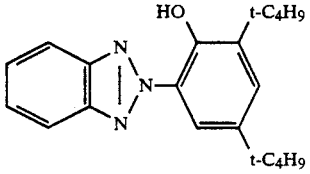

Polysilanes: the same as those used in Example 1-(1)

TABLE 4

| Sample No | Kind of Polysilane | Degradation Inhibitor Kind | Degradation Inhibitor Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 34 | No. 18 | III-(1) | 3.0 | 800 | 50 | 10 | 810 | 60 | 15 | Invention |
| 35 | No. 1 | III-(1) | 3.0 | 800 | 45 | 10 | 810 | 55 | 15 | Invention |
| 36 | No. 1 | III-(1) | 50.0 | 800 | 80 | 10 | 805 | 85 | 15 | Invention |
| 37 | No. 8 | III-(1) | 3.0 | 800 | 50 | 10 | 810 | 60 | 15 | Invention |
| 38 | PI-1 | III-(1) | 3.0 | 800 | 55 | 10 | 810 | 65 | 15 | Invention |
| 39 | PI-2 | III-(1) | 3.0 | 800 | 50 | 10 | 810 | 60 | 15 | Invention |
| 40 | PI-3 | III-(1) | 3.0 | 800 | 45 | 10 | 810 | 55 | 15 | Invention |
| 41 | No. 18 | III-(3) | 3.0 | 800 | 50 | 10 | 810 | 60 | 15 | Invention |
| 42 | No. 18 | — | — | 800 | 45 | 5 | 850 | 150 | 100 | Comparison |
| 43 | PI-1 | — | — | 800 | 45 | 5 | 860 | 155 | 105 | Comparison |
| 44 | No. 18 | AO-1 | 3.0 | 800 | 50 | 10 | 830 | 130 | 80 | Comparison |

*given in wt % of polysilane

As apparent from Table 4, the samples of the invention were satisfactory in all the black original copying electric potential, white original copying electric potential and residual electric potential, before and after the 100,000-cycle copying.

EXAMPLE 2-(2)

Photoreceptor sample Nos. 45 to 55 were prepared and evaluated in the same procedure as in Example 2-(1), except that the type of the degradation inhibitor was changed. The evaluation results are shown in Table 5. The polysilane and the degradation inhibitor were used as indicated in Table 5. 0142

Degradation inhibitors (invention)

the same compounds as those used in Example 1-(2)

Degradation inhibitor (for comparison)

the same compound as that used in Example 1-(2)
Polysilanes: the same as those used in Example 1-(1)

As apparent from Table 5, the samples of the invention were satisfactory in all the black original copying electric potential, white original copying electric potential and residual electric potential, before and after the 100,000-cycle copying.

EXAMPLE 2-(3)

Photoreceptor sample Nos. 56 to 66 were prepared and evaluated in the same procedure as in Example 2-(1), except that the type of the degradation inhibitor was changed. The evaluation results are shown in Table 6. The polysilane and the degradation inhibitor were used as indicated in Table 6.

Degradation inhibitors (invention)

the same compound as those used in Example 1-(3)

Degradation inhibitor (for comparison)

the same compound as that used in Example 1-(3)
Polysilanes: the same as those used in Example 1-(1)

TABLE 5

| Sample No | Kind of Polysilane | Degradation Inhibitor Kind | Degradation Inhibitor Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 45 | No. 18 | IV-(2) | 3.0 | 800 | 55 | 10 | 810 | 65 | 15 | Invention |
| 46 | No. 1 | IV-(2) | 3.0 | 800 | 50 | 10 | 810 | 60 | 15 | Invention |
| 47 | No. 1 | IV-(2) | 50.0 | 800 | 75 | 10 | 805 | 80 | 15 | Invention |
| 48 | No. 8 | IV-(2) | 3.0 | 800 | 55 | 10 | 810 | 65 | 15 | Invention |
| 49 | PI-1 | IV-(2) | 3.0 | 800 | 60 | 10 | 810 | 70 | 15 | Invention |
| 50 | PI-2 | IV-(2) | 3.0 | 800 | 55 | 10 | 810 | 65 | 15 | Invention |
| 51 | PI-3 | IV-(2) | 3.0 | 800 | 55 | 10 | 810 | 65 | 15 | Invention |
| 52 | No. 18 | IV-(6) | 3.0 | 800 | 50 | 10 | 810 | 60 | 15 | Invention |
| 53 | No. 18 | — | — | 800 | 45 | 5 | 855 | 155 | 105 | Comparison |
| 54 | PI-1 | — | — | 800 | 50 | 5 | 860 | 160 | 110 | Comparison |
| 55 | No. 18 | AO-1 | 3.0 | 800 | 60 | 10 | 830 | 135 | 85 | Comparison |

*given in wt % of polysilane

TABLE 6

| Sample No | Kind of Polysilane | Degradation Inhibitor Kind | Degradation Inhibitor Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 56 | No. 18 | V-(1) | 3.0 | 800 | 50 | 10 | 810 | 60 | 15 | Invention |
| 57 | No. 1 | V-(1) | 3.0 | 800 | 55 | 10 | 810 | 65 | 15 | Invention |
| 58 | No. 1 | V-(1) | 50.0 | 800 | 70 | 10 | 805 | 75 | 15 | Invention |
| 59 | No. 8 | V-(1) | 3.0 | 800 | 55 | 10 | 810 | 65 | 15 | Invention |
| 60 | PI-1 | V-(1) | 3.0 | 800 | 60 | 10 | 810 | 70 | 15 | Invention |
| 61 | PI-2 | V-(1) | 3.0 | 800 | 60 | 10 | 810 | 70 | 15 | Invention |
| 62 | PI-3 | V-(1) | 3.0 | 800 | 55 | 10 | 810 | 65 | 15 | Invention |
| 63 | No. 18 | V-(3) | 3.0 | 800 | 55 | 10 | 810 | 65 | 15 | Invention |
| 64 | No. 18 | — | — | 800 | 45 | 5 | 860 | 155 | 105 | Comparison |
| 65 | PI-1 | — | — | 800 | 50 | 5 | 855 | 150 | 100 | Comparison |
| 66 | No. 18 | AO-1 | 3.0 | 800 | 60 | 10 | 830 | 135 | 85 | Comparison |

*given in wt % of polysilane

As apparent from Table 6, the samples of the invention were satisfactory in all the black original copying electric potential, white original copying electric potential and residual electric potential, before and after the 100,000-cycle copying.

EXAMPLE 3-(1)

Synthesis of titanylphthalocyanine

To a mixture of 65 g of phthalocyanine and 500 ml of α-chloronaphthalene was added dropwise 14.7 ml of titanium tetrachloride in a nitrogen stream. The temperature of the mixture was gradually raised to 200° C., and the mixture was stirred for 3 hours at 200° to 220° C. to complete the reaction and then allowed to cool. When the temperature dropped to 130° C., the reaction product was filtered, washed with α-chloronaphthalene and further washed with methanol several times, followed by washing with water of 80° several times.

After drying, 5 g of the produce was added to 100 g of 96% sulfuric acid and stirred at 3° to 5° C., the sulfuric acid solution was filtered and then poured into 1.5 liter of water. The crystals deposited were filtered out and washed repeatedly with water till the washing liquor became neutral.

Then, the filter was mixed with 1,2-dichloroethane and stirred for 1 hour, followed by filtration and washing with methanol to obtain titanylphthalocyanine crystals. The crystal had a maximum intensity peak at a Bragg angle (2θ) of 27.3° and showed characteristic peaks at 9.6°, 11.7°, 24.1°, as shown in FIG. 2.

Preparation of photoreceptor sample Nos. 67 to 77

A 0.15 μm thick subbing layer consisting of copolymer polyamide CM-8000 (product of Toray Ind.) was formed on an aluminium-deposited polyethylene terephthalate base support. Then, 1 part of the above titanylphthalocyanine having the X-ray diffraction pattern of FIG. 2 and 1 part of polyvinyl butyral XYHL (product of Union Carbide Corp.) as a binder resin were dispersed in 100 parts of methyl ethyl ketone in a sand mill. The dispersion was coated on the above subbing layer with a wire bar so as to form a 0.2 μm charge generation layer.

Subsequently, a solution, prepared by dissolving 7.5 parts in total of a polysilane and a degradation inhibitor in 25 parts of toluene, was coated and dried on the charge generation layer with a blade coater to give a 15 μm thick charge transport layer. Photoreceptor sample Nos. 67 to 77 were prepared by repeating the above procedure. The polysilane and the degradation inhibitor were used as shown in Table 7.

Each of sample Nos. 67 to 77 was evaluated using a modified Konica DC8010 (product of Konica Corp.) Initial electric potential unexposed part $V_{HO}$, initial electric potential in exposed part $V_{LO}$, initial residual electric potential $V_{RO}$ were determined to evaluate the sensitivity. After carrying out a 100,000-cycle copying, electric potential unexposed part $V_H$, electric potential in exposed part $V_L$, residual electric potential $V_R$ were determined. The results are shown in Table 7.

Degradation inhibitors (invention)

III-(1)

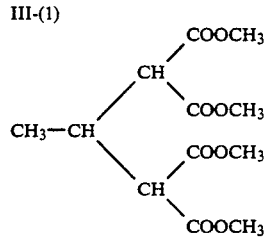

III-(3)

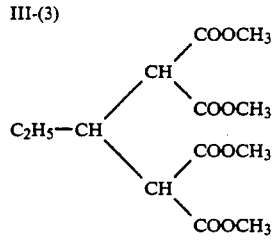

Degradation inhibitor (for comparison)

AO-1 TINUVIN 320 (product of Ciba-Geigy AG)

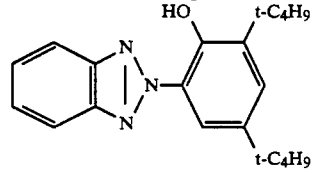

Polysilanes: the same as those used in Example 1-(1)

TABLE 7

| Sample No | Kind of Polysilane | Degradation Inhibitor Kind | Degradation Inhibitor Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 67 | No. 18 | III-(1) | 3.0 | 600 | 50 | 5 | 610 | 60 | 10 | Invention |
| 68 | No. 18 | III-(1) | 50.0 | 600 | 70 | 10 | 605 | 75 | 10 | Invention |
| 69 | No. 1 | III-(1) | 3.0 | 600 | 55 | 10 | 610 | 65 | 15 | Invention |
| 70 | No. 8 | III-(1) | 3.0 | 600 | 50 | 5 | 610 | 60 | 10 | Invention |
| 71 | PI-1 | III-(1) | 3.0 | 600 | 55 | 10 | 610 | 65 | 15 | Invention |
| 72 | PI-2 | III-(1) | 3.0 | 600 | 50 | 10 | 610 | 60 | 15 | Invention |
| 73 | PI-3 | III-(1) | 3.0 | 600 | 50 | 10 | 610 | 60 | 15 | Invention |
| 74 | No. 18 | III-(2) | 3.0 | 600 | 50 | 5 | 610 | 60 | 10 | Invention |
| 75 | No. 18 | — | — | 600 | 45 | 5 | 700 | 110 | 80 | Comparison |
| 76 | PI-1 | — | — | 600 | 40 | 5 | 695 | 105 | 75 | Comparison |
| 77 | No. 18 | AO-1 | 3.0 | 600 | 50 | 5 | 650 | 80 | 50 | Comparison |

given in Wt % of polysilane

As apparent from Table 7, the samples according to the invention gave satisfactory values in all of the electric potential unexposed part, electric potential in exposed part and residual electric potential, before and after the 100,000-cycle copying.

EXAMPLE 3-(2)

Photoceptor sample Nos. 78 to 88 were prepared and evaluated in the same procedure as in Example 3-(1), except that the type of the degradation inhibitor was changed. The evaluation results are shown in Table 8. The polysilane and the degradation inhibitor were used as indicated in Table 8.

Degradation inhibitors (invention)

the compounds same as those used in Example 1-(2)

Degradation inhibitor (for comparison)

the same compound as that used in Example 1-(2)
Polysilanes: the same as those used in Example 1-(1)

As apparent from Table 8, the samples according to the invention gave satisfactory values in all of the electric potential unexposed part, electric potential in exposed part and residual electric potential, before and after the 100,000-cycle copying.

EXAMPLE 3-(3)

Photoreceptor sample Nos. 89 to 99 were prepared and evaluated in the same procedure as in Example 3-(1), except that the type of the degradation inhibitor was changed. The evaluation results are shown in Table 9. The polysilane and the degradation inhibitor were used as indicated in Table 9.

Degradation inhibitors (invention)

the compounds same as those used in Example 1-(3)

Degradation inhibitor (for comparison)

the same compound as that used in Example 1-(3)
Polysilanes: the same as those used in Example 1-(1)

TABLE 8

| Sample No | Kind of Polysilane | Degradation Inhibitor Kind | Degradation Inhibitor Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 78 | No. 18 | IV-(2) | 3.0 | 600 | 50 | 5 | 610 | 60 | 10 | Invention |
| 79 | No. 18 | IV-(2) | 50.0 | 600 | 65 | 10 | 605 | 70 | 10 | Invention |
| 80 | No. 1 | IV-(2) | 3.0 | 600 | 50 | 10 | 610 | 60 | 15 | Invention |
| 81 | No. 8 | IV-(2) | 3.0 | 600 | 55 | 10 | 610 | 65 | 15 | Invention |
| 82 | PI-1 | IV-(2) | 3.0 | 600 | 60 | 10 | 610 | 70 | 15 | Invention |
| 83 | PI-2 | IV-(2) | 3.0 | 600 | 55 | 10 | 610 | 65 | 15 | Invention |
| 84 | PI-3 | IV-(2) | 3.0 | 600 | 50 | 10 | 610 | 60 | 15 | Invention |
| 85 | No. 18 | IV-(6) | 3.0 | 600 | 50 | 5 | 610 | 60 | 10 | Invention |
| 86 | No. 18 | — | — | 600 | 45 | 5 | 700 | 115 | 85 | Comparison |
| 87 | PI-1 | — | — | 600 | 45 | 5 | 700 | 110 | 80 | Comparison |
| 88 | No. 18 | AO-1 | 3.0 | 600 | 50 | 5 | 660 | 85 | 55 | Comparison |

*given in Wt % of polysilane

TABLE 9

| Sample No | Kind of Polysilane | Degradation Inhibitor Kind | Degradation Inhibitor Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 89 | No. 18 | V-(1) | 3.0 | 600 | 50 | 5 | 610 | 60 | 10 | Invention |
| 90 | No. 18 | V-91) | 50.0 | 600 | 65 | 10 | 605 | 70 | 10 | Invention |
| 91 | No. 1 | V-(1) | 3.0 | 600 | 50 | 10 | 610 | 60 | 15 | Invention |
| 92 | No. 8 | V-(1) | 3.0 | 600 | 55 | 10 | 610 | 65 | 15 | Invention |
| 93 | PI-1 | V-(1) | 3.0 | 600 | 60 | 10 | 610 | 70 | 15 | Invention |
| 94 | PI-2 | V-(1) | 3.0 | 600 | 55 | 10 | 610 | 65 | 15 | Invention |
| 95 | PI-3 | V-(1) | 3.0 | 600 | 55 | 10 | 610 | 65 | 15 | Invention |
| 96 | No. 18 | V-(3) | 3.0 | 600 | 50 | 5 | 610 | 60 | 10 | Invention |
| 97 | No. 18 | — | — | 600 | 45 | 5 | 695 | 110 | 80 | Comparison |
| 98 | PI-1 | — | — | 600 | 40 | 5 | 695 | 110 | 75 | Comparison |
| 99 | No. 18 | AO-1 | 3.0 | 600 | 50 | 10 | 670 | 90 | 60 | Comparison |

*given in Wt % of polysilane

As apparent from Table 9, the samples according to the invention gave satisfactory values in all of the electric potential unexposed part, electric potential in exposed part and residual electric potential, before and after the 100,000-cycle copying.

EXAMPLE 4-(1)

Preparation of photoreceptor sample Nos. 101 to 111

Using vinyl chloride-vinyl acetate-maleic anhydride copolymer Eslec MF-10 (product of Sekisui Chemical Co.), a 0.1-μm thick intermediate layer was formed on a conductive support comprised of an aluminium deposited polyethylene terephthalate base.

A coating solution was prepared by dispersing 1 part of 4,10-dibromoanthanthrone represented by the following formula (CGM-1) (Monolite Red 2Y made by ICI Ltd.), 0.5 part of polycarbonate resin Panlite L-1250 (product of Teijin Kasei Co.) and 1.0 part of charge transfer material CTM-I in 100 parts of 1,2-dichloroethane for 24 hours in a ball mill. Then, the dispersion was coated to a dry thickness of 0.5 μm on the above intermediate layer by the dipping method to form a charge generation layer.

Subsequently, a coating solution was prepared by mixing a polysilane and a degradation inhibitor with toluene (polysilane +degradation inhibitor/toluene =15W/V%), and the solution was coated on the above charge generation layer to give a charge transport layer having a dry thickness of 20 μm. By repeating the above procedure, electrophotographic photoreceptor sample Nos. 101 to 111 were prepared. The polysilane and the degradation inhibitor were used as indicated in Table 10.

Each of sample Nos. 101 to 111 was evaluated using a modified Konica 1550MR made by Konica Corp. Initial black original copying electric potential $V_{BO}$, initial residual electric potential $V_{RO}$ were determined to evaluate the sensitivity. After carrying out a 100,000-cycle copying test, black original copying electric potential $V_B$, white original copying electric potential $V_W$, residual electric potential $V_R$ were determined. The results are shown in Table 10.

CTM-I

-continued

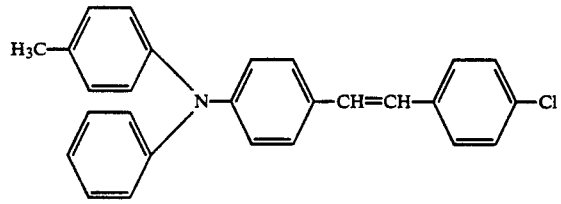

CGM-1

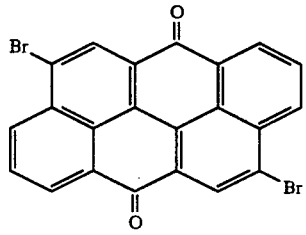

Polysilane (I)
I Polyphenylmethylsilane
(Exemplified No. 18)

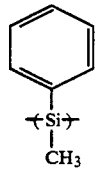

Ip = 5.62
molecular weight MN = $7.0 \times 10^3$
Mw = $4.0 \times 10^5$

II Polypropylmethylsilane
(Exemplified No. 1)

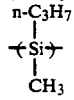

Ip = 5.77
molecular weight MN = $7.0 \times 10^3$
Mw = $2.5 \times 10^5$

III Polycyclohexylmethylsilane
(Exemplified No. 8)

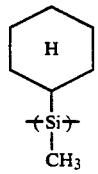

Ip = 5.92
molecular weight MN = $8.0 \times 10^3$
Mw = $3.0 \times 10^5$

Polysilane (II)
PI-1

-continued

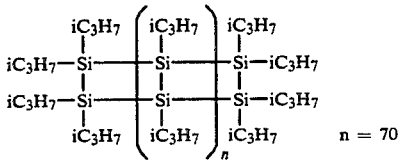

n = 70

PI-2

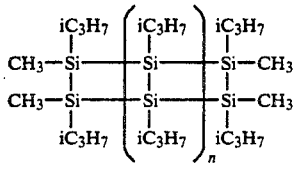

n = 50

PI-3

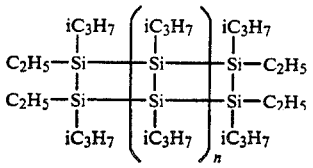

n = 60

-continued

Exemplified compound III-54:

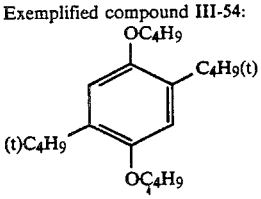

Degradation inhibitor (comparison)

IRGANOX 1010 (product of Ciba-Geigy AG)
AO-1:

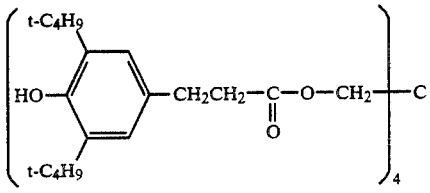

TABLE 10

| Sample No | Kind of Polysilane | Degradation Inhibitor: Kind | Degradation Inhibitor: Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 101 | No. 18 | VI-54 | 3.0 | 600 | 50 | 10 | 610 | 60 | 15 | Invention |
| 102 | No. 1 | VI-54 | 3.0 | 600 | 45 | 5 | 605 | 55 | 10 | Invention |
| 103 | No. 8 | VI-54 | 3.0 | 600 | 55 | 10 | 610 | 65 | 15 | Invention |
| 104 | PI-1 | VI-54 | 3.0 | 600 | 60 | 10 | 610 | 70 | 15 | Invention |
| 105 | PI-2 | VI-54 | 3.0 | 600 | 55 | 10 | 610 | 65 | 15 | Invention |
| 106 | PI-3 | VI-54 | 3.0 | 600 | 55 | 10 | 610 | 65 | 15 | Invention |
| 107 | No. 1 | VI-54 | 50.0 600 | | 80 | 10 | 605 | 85 | 15 | Invention |
| 108 | No. 1 | VI-21 | 3.0 | 600 | 50 | 5 | 605 | 55 | 10 | Invention |
| 109 | No. 1 | — | — | 600 | 45 | 5 | 650 | 130 | 100 | Comparison |
| 110 | PI-1 | — | — | 600 | 60 | 10 | 660 | 135 | 110 | Comparison |
| 111 | No. 18 | AO-1 | 3.0 | 600 | 60 | 10 | 630 | 100 | 70 | Comparison |

*given in Wt % of polysilane

Degradation inhibitors (invention)

Exemplified compound III-21:

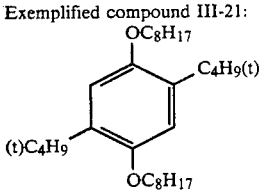

As seen in Table 10, the samples according to the invention exhibited satisfactory results in all the black original copying electric potential, white original copying electric potential and residual electric potential, before and after the 100,000-cycle copying.

EXAMPLE 4-(2)

Photoreceptor sample Nos. 121 to 131 were prepared and evaluated in the same manner as in Example 4-(1), except that the type of the degradation inhibitor was changed. The evaluation results are summarized in Table 11. The polysilane and the degradation inhibitor were used as shown in Table 11.

TABLE 11

| Sample No | Kind of Polysilane | Degradation Inhibitor: Kind | Degradation Inhibitor: Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 121 | No. 18 | VII-1 | 3.0 | 600 | 45 | 5 | 610 | 50 | 10 | Invention |
| 122 | No. 1 | VII-1 | 3.0 | 600 | 48 | 7 | 613 | 54 | 12 | Invention |
| 123 | No. 8 | VII-1 | 3.0 | 600 | 50 | 10 | 615 | 58 | 15 | Invention |
| 124 | PI-1 | VII-1 | 3.0 | 600 | 53 | 12 | 617 | 60 | 18 | Invention |

TABLE 11-continued

| Sample No | Kind of Polysilane | Degradation Inhibitor Kind | Degradation Inhibitor Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 125 | PI-2 | VII-1 | 3.0 | 600 | 50 | 10 | 616 | 60 | 17 | Invention |
| 126 | PI-3 | VII-1 | 3.0 | 600 | 47 | 13 | 615 | 58 | 17 | Invention |
| 127 | No. 1 | VII-1 | 50.1 | 600 | 90 | 15 | 610 | 100 | 20 | Invention |
| 128 | No. 1 | VI-2 | 3.0 | 600 | 50 | 8 | 612 | 55 | 13 | Invention |
| 129 | No. 1 | — | — | 600 | 45 | 5 | 660 | 140 | 100 | Comparison |
| 130 | PI-1 | — | — | 600 | 50 | 6 | 665 | 145 | 110 | Comparison |
| 131 | No. 18 | AO-2 | 3.0 | 600 | 50 | 7 | 625 | 100 | 80 | Comparison |

*given in Wt % of polysilane

As apparent from Table 11, the samples according to the invention gave satisfactory values in all the black original copying electric potential, white original copying electric potential and residual electric potential, before and after the 100,000-cycle copying.

Degradation inhibitors (invention)

EXAMPLE 4-(3)

Photoreceptor sample Nos. 141 to 151 were prepared and evaluated in the same manner as in Example 4-(1), except that the type of the degradation inhibitor was changed. The evaluation results are summarized in Table 12. The polysilane and the degradation inhibitor were used as shown in Table 12.

TABLE 12

| Sample No | Kind of Polysilane | Degradation Inhibitor Kind | Degradation Inhibitor Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 141 | No. 18 | VIII-12 | 3.0 | 600 | 40 | 5 | 605 | 50 | 10 | Invention |
| 142 | No.1 | VIII-12 | 3.0 | 600 | 45 | 7 | 610 | 55 | 12 | Invention |
| 143 | No. 8 | VIII-12 | 3.0 | 600 | 43 | 7 | 607 | 53 | 12 | Invention |
| 144 | PI-1 | VIII-12 | 3.0 | 600 | 47 | 8 | 612 | 57 | 13 | Invention |
| 145 | PI-2 | VIII-12 | 3.0 | 600 | 50 | 10 | 615 | 60 | 15 | Invention |
| 146 | PI-3 | VIII-12 | 3.0 | 600 | 48 | 9 | 613 | 58 | 13 | Invention |
| 147 | No. 1 | VIII-12 | 50.0 | 600 | 85 | 15 | 610 | 90 | 20 | Invention |
| 148 | No. 1 | VIII-3 | 3.0 | 600 | 47 | 9 | 612 | 57 | 13 | Invention |
| 149 | No. 1 | — | — | 600 | 40 | 5 | 670 | 150 | 105 | Comparison |
| 150 | PI-1 | — | — | 600 | 43 | 7 | 680 | 160 | 110 | Comparison |
| 151 | No. 18 | AO-3 | 3.0 | 600 | 50 | 10 | 630 | 95 | 85 | Comparison |

*given in Wt % of polysilane

Exemplified compound IV-1:

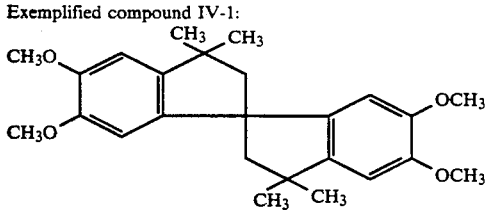

Exemplified compound IV-2:

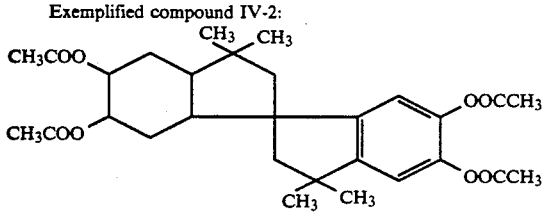

Degradation inhibitor (comparison)

AO-2: the same as AO-1

Polysilanes: the same as those used in Example 4-(1)

As apparent from Table 12, the samples according to the invention gave satisfactory values in all the black original copying electric potential, white original copying electric potential and residual electric potential, before and after the 100,000-cycle copying.

Degradations inhibitor (invention)

Exemplified compound V-3:

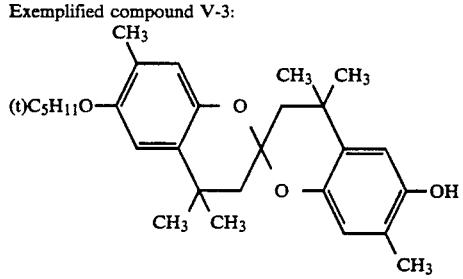

Exemplified compound V-12:

-continued

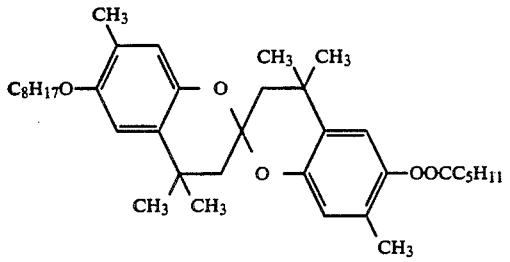

Degradation inhibitor (comparison)

AO-3: the same as AO-1

Polysilanes the same as those used in Example 4-(1)

EXAMPLE 5-(I)

Preparation of photoreceptor sample Nos. 161 to 171

A 0.1-μm thick intermediate layer consisting of nylon copolymer X1874M (product of Daicel H01s LTD) was formed on a conductive support comprised of an aluminium deposited polyethylene terephthalate base.

A coating solution was prepared by dispersing 1 part of the bisazo pigment represented by the following structural formula, 0.5 part of polycarbonate resin Panlite L-1300 (product of Teijin Kasei Co.) and 1.0 part of charge transport material CTM-II in 100 parts of tetrahydrofuran for 24 hours in a ball mill, then the solution was coated by the dipping method on the above intermediate layer so as to form a charge generation layer having a dry thickness of 0.4 μm.

Subsequently, a coating solution was prepared by use of the polysilane and the degradation inhibitor as shown in Table 13 and, then, coated and dried on the charge generation layer so as to give a 20-μm thick charge transport layer. By repeating the above procedure, electrophotographic photoreceptor sample Nos. 161 to 171 were prepared. The coating solution for the charge transport layer was prepared by dissolving the polysilane and the degradation inhibitor in tetrahydrofuran (polysilane +degradation inhibitor =15W/V%), and no binder resin was contained in it.

Sample Nos. 161 to 171 were each evaluated by use of a modified Konica 5570MR (product of Konica Corp.). Initial black original copying electric potential $V_{BO}$, initial white original copying electric potential $V_{WO}$ and initial residual electric potential $V_{RO}$ were determined to evaluate the sensitivity. After conducting a 100,000-cycle copying test, black original copying electric potential $V_B$, white original copying electric potential $V_W$ and initial residual electric potential $V_R$ were determined. The evaluation results are shown in Table 13.

Bisazo pigment:

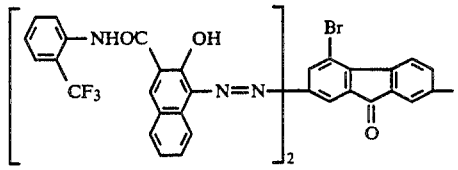

CTM-II

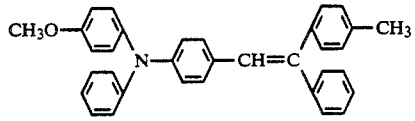

Degradation inhibitors (invention)

Exemplified compound III-21:

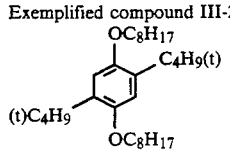

Exemplified compound III-54:

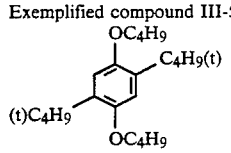

Degradation inhibitor (comparison)

AO-4: the same as AO-1

Polysilanes: the same as those used in Example 4-(1)

TABLE 13

| Sample No | Kind of Polysilane | Degradation Inhibitor: Kind | Degradation Inhibitor: Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 161 | No. 18 | VI-54 | 3.0 | 800 | 50 | 10 | 810 | 60 | 15 | Invention |
| 162 | No. 1 | VI-54 | 3.0 | 800 | 50 | 5 | 810 | 55 | 10 | Invention |
| 163 | No. 1 | VI-54 | 50.0 | 800 | 80 | 10 | 805 | 85 | 15 | Invention |
| 164 | No. 8 | VI-54 | 3.0 | 800 | 60 | 10 | 810 | 70 | 15 | Invention |
| 165 | PI-1 | VI-54 | 3.0 | 800 | 65 | 10 | 810 | 75 | 15 | Invention |
| 166 | PI-2 | VI-54 | 3.0 | 800 | 65 | 15 | 810 | 75 | 20 | Invention |
| 167 | PI-3 | VI-54 | 3.0 | 800 | 60 | 10 | 810 | 70 | 15 | Invention |
| 168 | No. 1 | VI-21 | 3.0 | 800 | 55 | 5 | 810 | 60 | 10 | Invention |
| 169 | No. 1 | — | — | 800 | 45 | 5 | 850 | 150 | 100 | Comparison |
| 170 | PI-1 | — | — | 800 | 50 | 5 | 860 | 160 | 105 | Comparison |
| 171 | No. 18 | AO-4 | 3.0 | 800 | 60 | 10 | 830 | 100 | 75 | Comparison |

*given in Wt % of polysilane

As apparent from Table 13, the samples according to the invention gave satisfactory values in all the black original copying electric potential, white original copying electric potential and residual electric potential, before and after the 100,000-cycle copying.

EXAMPLE 5-(2)

Photoreceptor sample Nos. 181 to 191 were prepared and evaluated in the same manner as in Example 5-(1), except that the type of the degradation inhibitor was changed. The evaluation results are shown in Table 14. The polysilane and the degradation inhibitor were used as shown in Table 14.

-continued

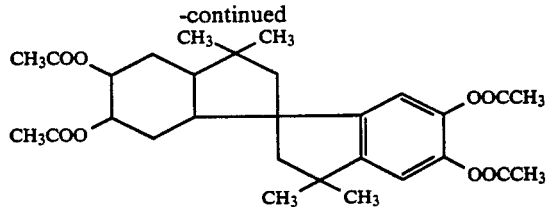

TABLE 14

| Sample No | Kind of Polysilane | Degradation Inhibitor Kind | Degradation Inhibitor Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 181 | No. 18 | VII-1 | 3.0 | 800 | 55 | 15 | 810 | 60 | 20 | Invention |
| 182 | No. 1 | VII-1 | 3.0 | 800 | 57 | 17 | 812 | 63 | 23 | Invention |
| 183 | No. 8 | VII-1 | 3.0 | 800 | 57 | 18 | 813 | 64 | 22 | Invention |
| 184 | PI-1 | VII-1 | 3.0 | 800 | 60 | 20 | 815 | 63 | 25 | Invention |
| 185 | PI-2 | VII-1 | 3.0 | 800 | 58 | 19 | 815 | 65 | 24 | Invention |
| 186 | PI-3 | VII-1 | 3.0 | 800 | 56 | 17 | 813 | 64 | 22 | Invention |
| 187 | No. 1 | VII-2 | 50.0 | 800 | 80 | 25 | 820 | 10 | 30 | Invention |
| 188 | No. 1 | VII-2 | 3.0 | 800 | 60 | 22 | 815 | 67 | 25 | Invention |
| 189 | No. 1 | — | — | 800 | 50 | 10 | 870 | 150 | 100 | Comparison |
| 190 | PI-1 | — | — | 800 | 55 | 15 | 880 | 160 | 110 | Comparison |
| 191 | No. 18 | AO-5 | 3.0 | 800 | 60 | 25 | 840 | 100 | 70 | Comparison |

*given in Wt % of polysilane

As apparent from Table 14, the samples according to the invention gave satisfactory values in all the black original copying electric potential, white original copying electric potential and residual electric potential, before and after the 100,000-cycle copying.

Degradation inhibitors (invention)

Exemplified compound IV-1:

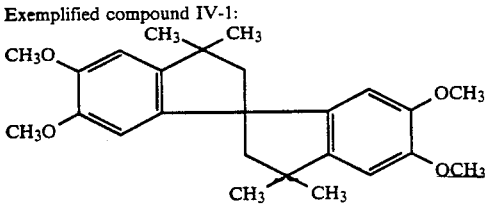

Degradation inhibitor (comparison)

AO-5: the same as AO-1

Polysilanes: the same as those used in Example 4-(1)

EXAMPLE 5-(3)

Photoreceptor sample Nos. 201 to 211 were prepared and evaluated in the same manner as in Example 5-(1), except that the type of the degradation inhibitor was changed. The evaluation results are shown in Table 15. The polysilane and the degradation inhibitor were used as shown in Table 15.

TABLE 15

| Sample No | Kind of Polysilane | Degradation Inhibitor Kind | Degradation Inhibitor Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 201 | No. 18 | VIII-12 | 3.0 | 800 | 60 | 15 | 810 | 65 | 20 | Invention |
| 202 | No. 1 | VIII-12 | 3.0 | 800 | 65 | 20 | 815 | 70 | 25 | Invention |
| 203 | No. 8 | VIII-12 | 3.0 | 800 | 63 | 18 | 813 | 67 | 23 | Invention |
| 204 | PI-1 | VIII-12 | 3.0 | 800 | 65 | 21 | 817 | 73 | 26 | Invention |
| 205 | PI-2 | VIII-12 | 3.0 | 800 | 62 | 17 | 814 | 69 | 24 | Invention |
| 206 | PI-3 | VIII-12 | 3.0 | 800 | 65 | 18 | 816 | 72 | 23 | Invention |
| 207 | No. 1 | VIII-12 | 50.0 | 800 | 90 | 30 | 820 | 100 | 35 | Invention |
| 208 | No. 1 | VIII-3 | 3.0 | 800 | 61 | 16 | 810 | 67 | 21 | Invention |
| 209 | No. 1 | — | — | 800 | 55 | 10 | 880 | 145 | 105 | Comparison |
| 210 | PI-1 | — | — | 800 | 60 | 15 | 890 | 150 | 110 | Comparison |
| 211 | No. 18 | AO-5 | 3.0 | 800 | 70 | 30 | 840 | 110 | 90 | Comparison |

*given in Wt % of polysilane

As apparent from Table 15 the samples according to the invention gave satisfactory values in all the black original copying electric potential, white original copying electric potential and residual electric potential, before and after the 100,000-cycle copying.

Exemplified compound IV-2:

Degradations inhibitor (invention)

-continued

Exemplified compound V-3:

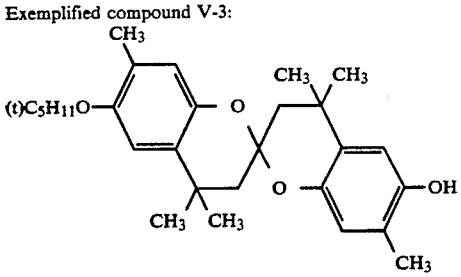

Exemplified compound V-12:

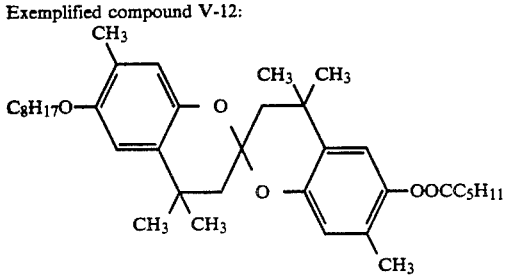

Degradation inhibitor (comparison)

AO-6: the same as AO-1

Polysilanes: the same as those used in Example 4-(1)

EXAMPLE 6-(1)

A titanylphthalocyanine was synthesized by a similar method as in Example 3-(1).

Preparation of photoreceptor sample Nos. 221 to 231

A 0.15-μm thick subbing layer consisting of copolymer polyamide CM-8000 (product of Toray Ind.) was formed on an aluminium-deposited polyethylene terephthalate base support. Then, a 0.2-μm thick charge generation layer was provided thereon by coating, with a wire bar, a coating solution prepared by dispersing, in a sand mill, 1 part of the above titanylphthalocyanine having the X-ray diffraction pattern shown in FIG. 2 and 1 part of polyvinyl butyral XYHL (product of Union Carbide Corp.) as a binder in 100 parts of methyl ethyl ketone.

Then, the polysilane and the degradation inhibitor in the total amount of 7.5 parts were dissolved in 25 parts of toluene. The solution obtained was coated with a blade coater to give a 15-μm thick charge transport layer. Electrophotographic photoreceptor sample Nos. 221 to 231 were prepared by repeating the above procedure. The polysilane and the degradation inhibitor were used as indicated in Table 16.

Sample Nos. 221 to 231 were each evaluated by use of a modified Konica DC8010 (product of Konica Corp.). Initial electric potential unexposed part $V_{HO}$, initial electric potential in exposed part $V_{LO}$ and initial residual electric potential $V_{RO}$ were determined to evaluate the sensitivity. After carrying out a 100,000-cycle copying test, electric potential unexposed part $V_H$, electric potential in exposed part $V_L$ and residual electric potential $V_R$ were determined. The evaluation results are shown in Table 7.

Degradation inhibitors (invention)

Exemplified compound III-21:

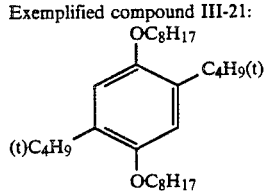

Exemplified compound III-54:

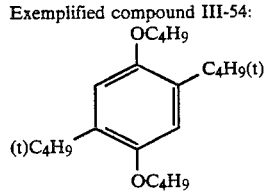

Degradation inhibitor (comparison)

AO-7: the same as AO-1

Polysilanes: the same as those used in Example 4-(1)

TABLE 16

| | | | | Initial Stage | | | After 100,000-cycle Copying | | | |
|---|---|---|---|---|---|---|---|---|---|---|
| | | Degradation Inhibitor | | | | | | | | |
| Sample No | Kind of Polysilane | Kind | Amount Added (%)* | The initial black original copying electric potential | The initial white original copying electric potential | The initial residual electric potential | The black original copying electric potential | The white original copying electric potential | The residual electric potential | Remarks |
| 221 | No. 1 | III-54 | 3.0 | 600 | 50 | 5 | 610 | 60 | 10 | Invention |
| 222 | No. 1 | III-54 | 50.0 | 600 | 70 | 10 | 610 | 80 | 15 | Invention |
| 223 | No. 8 | III-54 | 3.0 | 600 | 55 | 5 | 610 | 65 | 10 | Invention |
| 224 | No. 18 | III-54 | 3.0 | 600 | 50 | 5 | 610 | 55 | 10 | Invention |
| 225 | PI-1 | III-54 | 3.0 | 600 | 60 | 10 | 610 | 70 | 15 | Invention |
| 226 | PI-2 | III-54 | 3.0 | 600 | 55 | 5 | 610 | 65 | 10 | Invention |
| 227 | PI-3 | III-54 | 3.0 | 600 | 60 | 10 | 610 | 70 | 15 | Invention |
| 228 | No. 1 | III-21 | 3.0 | 600 | 50 | 5 | 610 | 60 | 10 | Invention |
| 229 | No. 1 | — | — | 600 | 45 | 5 | 700 | 110 | 80 | Comparison |
| 230 | PI-1 | — | — | 600 | 50 | 5 | 710 | 115 | 85 | Comparison |
| 231 | No. 18 | AO-1 | 3.0 | 600 | 75 | 15 | 650 | 100 | 90 | Comparison |

*given in Wt % of polysilane

As apparent from Table 16, the samples according to the invention gave satisfactory values in all the electric potential unexposed part, electric potential in exposed part and residual electric potential, before and after the 100,000-cycle copying.

EXAMPLE 6-(2)

Photoreceptor sample Nos. 231 to 241 were prepared and evaluated in the same manner as in Example 6-(1), except that the type of the degradation inhibitor was changed. The evaluation results are shown in Table 17. The polysilane and the degradation inhibitor were used as shown in Table 17.

-continued

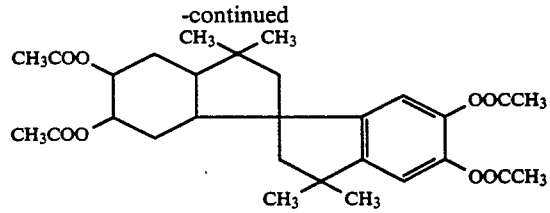

TABLE 17

| Sample No | Kind of Polysilane | Degradation Inhibitor Kind | Degradation Inhibitor Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 231 | No. 1 | IV-1 | 3.0 | 600 | 55 | 10 | 610 | 60 | 15 | Invention |
| 232 | No. 1 | IV-1 | 50.0 | 600 | 80 | 15 | 610 | 90 | 20 | Invention |
| 233 | No. 8 | IV-1 | 3.0 | 600 | 60 | 15 | 610 | 65 | 17 | Invention |
| 234 | No. 18 | IV-1 | 3.0 | 600 | 57 | 13 | 612 | 63 | 18 | Invention |
| 235 | PI-1 | IV-1 | 3.0 | 600 | 60 | 16 | 611 | 67 | 20 | Invention |
| 236 | PI-2 | IV-1 | 3.0 | 600 | 56 | 12 | 613 | 63 | 18 | Invention |
| 237 | PI-3 | IV-1 | 3.0 | 600 | 59 | 18 | 614 | 64 | 22 | Invention |
| 238 | No. 1 | IV-2 | 3.0 | 600 | 56 | 12 | 611 | 62 | 17 | Invention |
| 239 | No. 1 | — | — | 600 | 45 | 5 | 700 | 120 | 90 | Comparison |
| 240 | PI-1 | — | — | 600 | 47 | 7 | 705 | 125 | 95 | Comparison |
| 241 | No. 18 | AO-1 | 3.0 | 600 | 75 | 15 | 650 | 100 | 75 | Comparison |

*given in Wt % of polysilane

As apparent from Table 17, the samples according to the invention gave satisfactory values in all the electric potential unexposed part, electric potential in exposed part and residual electric potential, before and after the 100,000-cycle copying.

Degradation inhibitors (invention)

Exemplified compound IV-1:

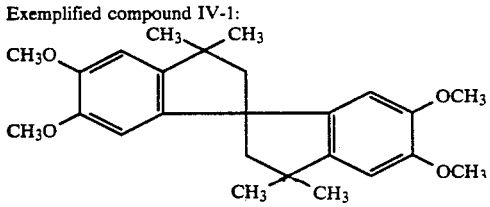

Exemplified compound IV-2:

Degradation inhibitor (comparison)

AO-8: the same as AO-1

Polysilanes: the same as those used in Example 4-(1)

EXAMPLE 6-(3)

Photoreceptor sample Nos. 251 to 261 were prepared and evaluated in the same manner as in Example 6-(1), except that the type of the degradation inhibitor was changed. The evaluation results are shown in Table 18. The polysilane and the degradation inhibitor were used as shown in Table 18.

TABLE 18

| Sample No | Kind of Polysilane | Degradation Inhibitor Kind | Degradation Inhibitor Amount Added (%)* | Initial Stage: The initial black original copying electric potential | Initial Stage: The initial white original copying electric potential | Initial Stage: The initial residual electric potential | After 100,000-cycle Copying: The black original copying electric potential | After 100,000-cycle Copying: The white original copying electric potential | After 100,000-cycle Copying: The residual electric potential | Remarks |
|---|---|---|---|---|---|---|---|---|---|---|
| 251 | No. 1 | V-12 | 3.0 | 600 | 50 | 10 | 610 | 55 | 15 | Invention |
| 252 | No. 1 | V-12 | 50.0 | 600 | 75 | 15 | 610 | 80 | 20 | Invention |
| 253 | No. 8 | V-12 | 3.0 | 600 | 55 | 15 | 610 | 60 | 20 | Invention |
| 254 | No. 18 | V-12 | 3.0 | 600 | 53 | 12 | 610 | 57 | 17 | Invention |
| 255 | PI-1 | V-12 | 3.0 | 600 | 57 | 17 | 610 | 62 | 21 | Invention |
| 256 | PI-2 | V-12 | 3.0 | 600 | 60 | 20 | 610 | 65 | 25 | Invention |
| 257 | PI-3 | V-12 | 3.0 | 600 | 59 | 19 | 610 | 64 | 23 | Invention |
| 258 | No. 1 | V-3 | 3.0 | 600 | 58 | 18 | 610 | 63 | 22 | Invention |
| 259 | No. 1 | — | — | 600 | 45 | 5 | 705 | 130 | 95 | Comparison |
| 260 | PI-1 | — | — | 600 | 47 | 7 | 710 | 133 | 100 | Comparison |
| 261 | No. 18 | AO-1 | 3.0 | 600 | 70 | 15 | 650 | 100 | 85 | Comparison |

*given in Wt % of polysilane

As apparent from Table 18, the samples according to the invention gave satisfactory values in all the electric potential unexposed part, electric potential in exposed part and residual electric potential, before and after the 100,000-cycle copying.

Degradations inhibitor (invention)

Exemplified compound V-3:

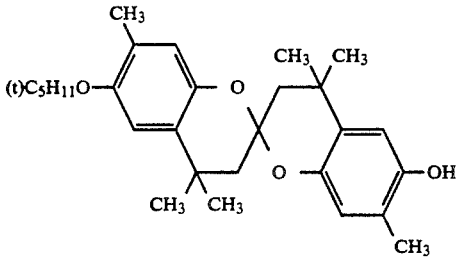

Exemplified compound V-12:

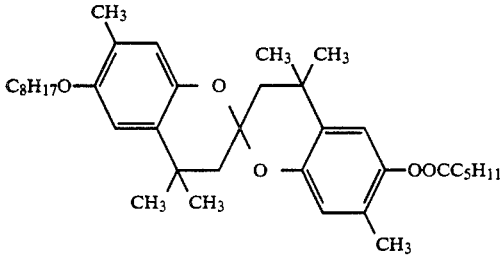

Degradation inhibitor (comparison)

AO-9: the same as AO-1

Polysilanes: the same as those used in Example 1-(1)

DESCRIPTION OF THE NUMERICAL SIGNS

Figure 1:
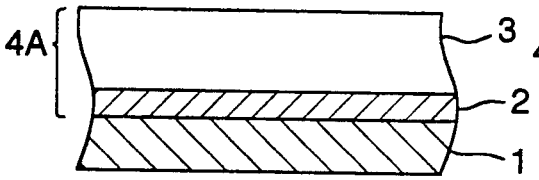
FIG. 1: (A), (B), (C) and (D) are sectional views each showing an configuration example of the photoreceptor of the invention.
Figure 1:
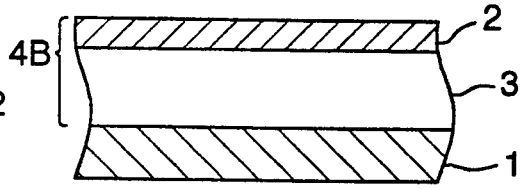
Figure 1:
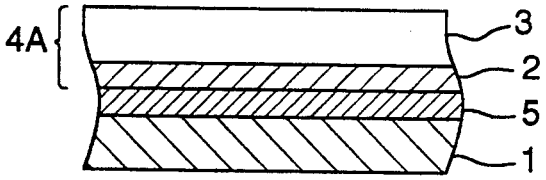
Figure 1:
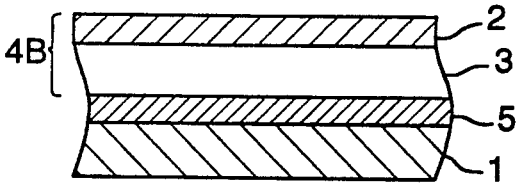
Figure 2:
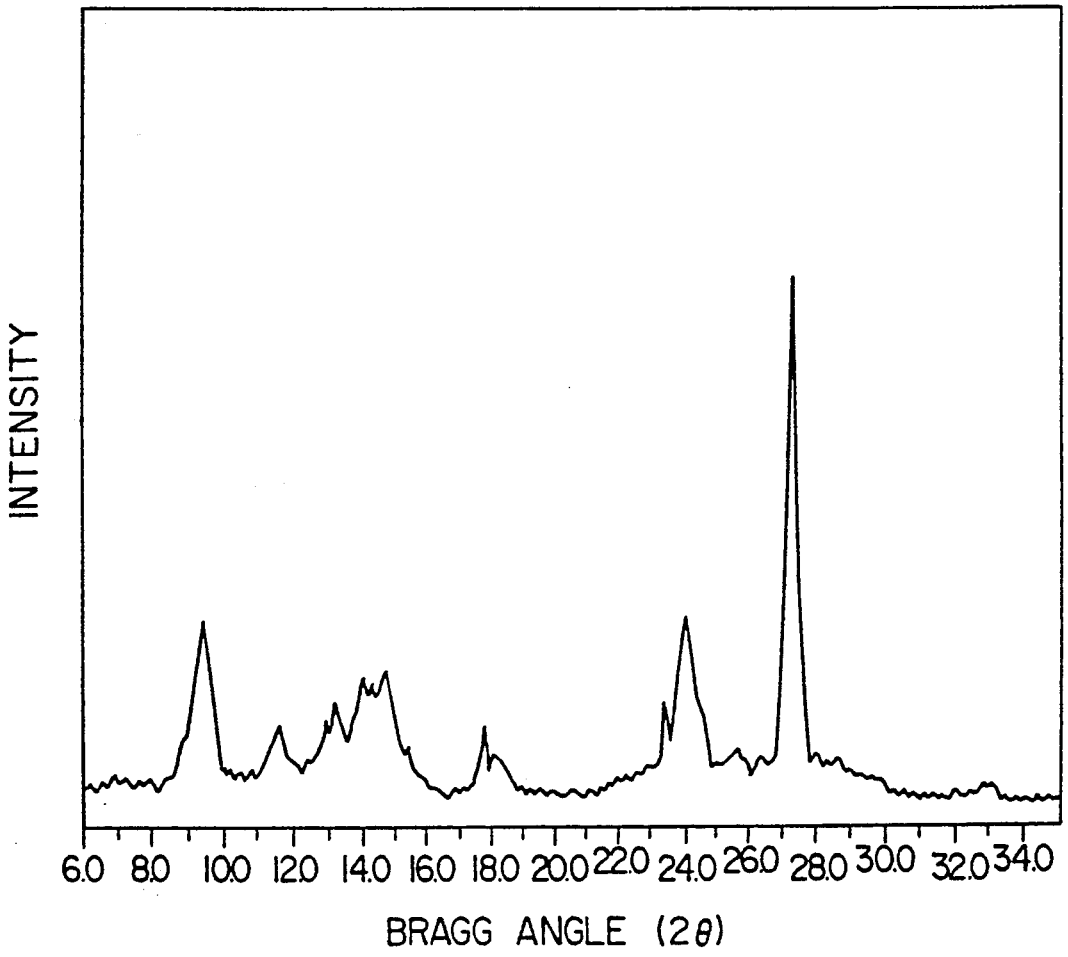
FIG. 2: a X-ray diffraction spectrum of the titanylphthalocyanine used in the invention.

1: a conductive support
2: a charge generation layer
3: a charge transport layer
4A, AB: photosensitive layers
5: an intermediate layer.

What is claimed is:

1. An electrophotographic photoreceptor which comprises a conductive substrate and a photosensitive layer composed of a charge generation layer and a charge transport layer, wherein the charge transport layer contains a polysilane which is a homopolymer or a copolymer having at least one of repeating units represented by Formula (I) and Formula (II), and at least one degradation inhibitor selected from the from the group consisting of Formula (III) through Formula (VIII).

Formula (I)

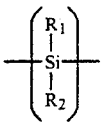

-continued

Formula (II)

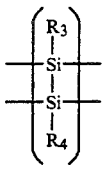

wherein $R_1$, $R_2$, $R_3$ and $R_4$ each is a hydrogen atom, a halogen atom, a substituted or unsubstituted alkyl group, a substituted or unsubstituted aryl group, a substituted or unsubstituted alkoxy group, an alkylsilyl group or an arylsilyl group, Formula (III)

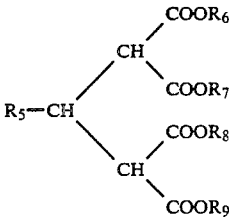

wherein $R_5$, $R_6$, $R_7$, $R_8$ and $R_9$ each is a hydrogen atom, an alkyl group, an aryl group, an aralkyl group, a cycloalkyl group or a heterocyclic group, Formula (IV)

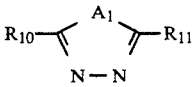

wherein $A_1$ is an oxygen atom or a sulfur atom, $R_{10}$ and $R_{11}$ each is an alkyl group, an aryl group, an alkenyl group, an aralkyl group or another organic group containing

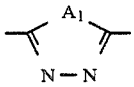

group, $R_{12}$-$A_2$-COCOOH Formula (V)

wherein $R_{12}$ is an aryl group or a substituted group, $A_2$ is —$CH_2$— or —CH=$CH_{13}$—, $R_{13}$ is a hydrogen atom or a halogen atom, Formula (VI)

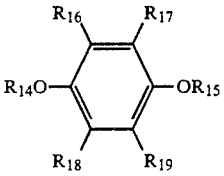

wherein $R_{14}$ and $R_{15}$ each is an alkyl group, an alkenyl group, a cycloalkyl group, an aryl group or a heterocyclic group, $R_{16}$, $R_{17}$, $R_{18}$ and $R_{19}$ each is a hydrogen atom, a halogen atom, an alkyl group, an alkenyl group, a cycloalkyl group, an aryl group, an alkoxy group, an alkylthio group, an arylthio group, an acyl group, an acylamino group, an alkylamino group, an alkoxycarbonyl group or a sulfonamide group; the total number of carbon atoms of $R_{14}$ and $R_{15}$ are 3 or more when both $R_{14}$ and $R_{15}$ are alkyl groups,

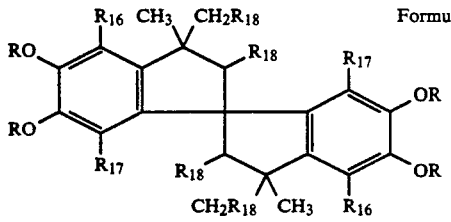

Formula (VII)

wherein R is an alkyl group, an alkenyl group, an aryl group, a heterocyclic group, $R_{19}CO$—, $R_{20}SO$—, or $R_{21}NHCO$—, $R_{16}$ and $R_{17}$ each is a hydrogen atom, a halogen atom, an alkyl group, an alkenyl group, an alkoxy group or an alkenyloxy group, $R_{18}$ is a hydrogen atom, an alkyl group, an alkenyl group or an aryl group, $R_{19}$, $R_{20}$ and $R_{21}$ each is an alkyl group, an alkenyl group, an aryl group or a heterocyclic group,

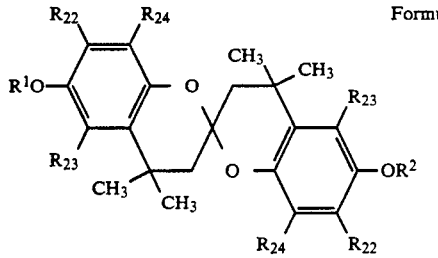

Formula (VIII)

wherein $R_{22}$ is an alkyl group, an alkenyl group, an aryl group, an alkenyloxy group or an aryloxy group, $R_{23}$ and $R_{24}$ each is a hydrogen atom, a halogen atom, an alkyl group, an alkenyl group or an alkoxy group, $R^1$ is an alkyl group, an alkenyl group, a cycloalkyl group, an aryl group, a heterocyclic group, $R_{25}CO$—, $R_{26}SO$—, or $R_{27}NHCO$—, $R_{25}$, $R_{26}$ and $R_{27}$ each is an alkyl group, an alkenyl group, a cycloalkyl group, an aryl group or a heterocyclic group.

2. The electrophotographic photoreceptor of claim 1, wherein said degradation inhibitors are the materials selected from the group consisting of Formula (III), Formula (IV) and Formula (V).

3. The electrophotographic photoreceptor of claim 2, further comprising 0.5 to 50 wt% based on the charge transport material of degradation inhibitors selected from the group consisting of compounds of Formula (III), Formula (IV) and Formula V.

4. The electrophotographic photoreceptor of claim 1, wherein said degradation inhibitors are compounds selected from the group consisting of Formula (VI), Formula (VII) and Formula (VIII).

5. The electrophotographic photoreceptor of claim 4, further comprising 0.5 to 50 wt% of said degradation inhibitors selected from the group consisting of compounds of Formula (VI), Formula (VII) and Formula (VIII), based on the amount of charge transport material.

6. An electrophotographic photoreceptor of claim 1, wherein the charge generation layer contains a titanylphthalocyanine pigment in a crystal structure having characteristic peaks at Bragg angles ($2\theta$) of at least $9.6° \pm 0.2°$ and $27.2° \pm 0.2°$ in an X-ray diffraction spectrum with a cu-K$\alpha$ radiation of at a wave length of 1.541 Å.

* * * * *